US009387955B2

(12) United States Patent
Broering et al.

(10) Patent No.: US 9,387,955 B2
(45) Date of Patent: Jul. 12, 2016

(54) MULTI-LAYERED THERMOPLASTIC BAG WITH REINFORCED SEALS AND METHODS OF MAKING THE SAME

(71) Applicant: The Glad Products Company, Oakland, CA (US)

(72) Inventors: Shaun T. Broering, Fort Thomas, KY (US); Jason R. Maxwell, Willowbrook, IL (US); Robert W. Fraser, Willowbrook, IL (US); Robert T. Dorsey, Willowbrook, IL (US); Kyle R. Wilcoxen, Willowbrook, IL (US); Michael G. Borchardt, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 143 days.

(21) Appl. No.: 13/837,663

(22) Filed: Mar. 15, 2013

(65) Prior Publication Data

US 2013/0202229 A1 Aug. 8, 2013

Related U.S. Application Data

(63) Continuation-in-part of application No. 13/479,691, filed on May 24, 2012, now Pat. No. 9,315,319, which is a continuation-in-part of application No. 13/357,892, filed on Jan. 25, 2012.

(51) Int. Cl.
*B65D 33/00* (2006.01)
*B31B 19/90* (2006.01)
(Continued)

(52) U.S. Cl.
CPC ..... *B65D 33/00* (2013.01); *B31B 19/90* (2013.01); *B65D 33/02* (2013.01); *B65D 33/28* (2013.01); *B65F 1/002* (2013.01); *B65F 1/0006* (2013.01); *B31B 2219/6061* (2013.01); *B31B 2219/6076* (2013.01); *B31B 2237/055* (2013.01);
(Continued)

(58) Field of Classification Search
CPC .... B65D 33/28; B65D 33/165; B65F 1/0006; B31B 19/90; B31B 2219/9029; B31B 2219/9035; B31B 2219/90
USPC ..... 383/75, 72; 493/214
See application file for complete search history.

(56) References Cited

U.S. PATENT DOCUMENTS 3,010,640 A * 11/1961 Kugler ..... 383/75
3,494,457 A 2/1970 Titchenal
(Continued)

FOREIGN PATENT DOCUMENTS

| | | |
|---|---|---|
| CA | 847605 | 7/1970 |
| WO | 9011230 A1 | 10/1990 |
| WO | 9729966 A1 | 8/1997 |

*Primary Examiner* — Nathan J Newhouse
*Assistant Examiner* — Peter Helvey
(74) *Attorney, Agent, or Firm* — Thomas C. Feix

(57) ABSTRACT

One or more implementations of a multi-layered bag with reinforced seals include an outer layer or bag and an inner layer or bag positioned within the outer layer or bag. The multi-layered bag further includes a draw tape positioned near the opening of the multi-layered bag. The draw tape can allow a user to at least partially close the multi-layered bag by drawing the layers of the bag together. The multi-layered bag further includes one or more tape seals that bond the draw tape to layers of the bag. The tape seals can be reinforced and include at least seven plies bonded together. One or more implementations further include methods of forming multi-layered bags with reinforced seals.

20 Claims, 16 Drawing Sheets

(51) Int. Cl.
*B65D 33/02* (2006.01)
*B65D 33/28* (2006.01)
*B65F 1/00* (2006.01)

(52) U.S. Cl.
CPC ..... *B31B2237/10* (2013.01); *B31B 2237/406* (2013.01); *B31B 2237/50* (2013.01)

(56) References Cited

U.S. PATENT DOCUMENTS 3,738,568 A * 6/1973 Ruda ..... 383/75
3,772,968 A * 11/1973 Ruda ..... 493/225
4,273,549 A 6/1981 Pezzana et al.
4,558,463 A * 12/1985 Boyd ..... 383/75
4,629,064 A 12/1986 Barner
4,735,308 A * 4/1988 Barner ..... 206/204
4,832,507 A * 5/1989 Herrington ..... 383/74
4,846,586 A 7/1989 Bruno
4,890,936 A 1/1990 Cooper
4,925,711 A 5/1990 Akao et al.
4,930,905 A * 6/1990 Sharps, Jr. ..... 383/75
4,993,844 A 2/1991 Robinson et al.
5,070,584 A 12/1991 Dais et al.
5,209,573 A * 5/1993 Freeman ..... 383/109
5,244,450 A 9/1993 Koehn
5,601,852 A 2/1997 Seemann
5,700,489 A 12/1997 Pottorff
5,716,137 A 2/1998 Meyer
5,804,265 A 9/1998 Saad et al.
5,881,883 A 3/1999 Siegelman
6,416,452 B1 7/2002 Meyer
6,561,696 B1 * 5/2003 Rusnak et al. ..... 383/75
7,914,207 B1 * 3/2011 Beam ..... 383/11
2001/0043763 A1 * 11/2001 Saad et al. ..... 383/63
2002/0191871 A1 * 12/2002 Malaspina ..... 383/75
2004/0179754 A1 9/2004 Taheri
2011/0164834 A1 * 7/2011 Stiglic et al. ..... 383/75
2012/0063704 A1 * 3/2012 Hoying et al. ..... 383/75

* cited by examiner

MULTI-LAYERED THERMOPLASTIC BAG WITH REINFORCED SEALS AND METHODS OF MAKING THE SAME

CROSS-REFERENCE TO RELATED APPLICATIONS

The present application is a continuation-in-part of U.S. patent application Ser. No. 13/479,691 filed May 24, 2012, which is a continuation-in-part of U.S. patent application Ser. No. 13/357,892 filed Jan. 25, 2012. The contents of each of the above-referenced applications are hereby incorporated by reference in their entirety.

BACKGROUND OF THE INVENTION

1. The Field of the Invention

The present invention relates generally to thermoplastic films and bags formed therefrom. More particularly, the present invention relates to thermoplastic bags including multiple layers.

2. Background and Relevant Art

Thermoplastic films are a common component in various commercial and consumer products. For example, grocery bags, trash bags, sacks, and packaging materials are products that are commonly made from thermoplastic films. Additionally, feminine hygiene products, baby diapers, adult incontinence products, and many other products include thermoplastic films to one extent or another.

The cost to produce products including thermoplastic film is directly related to the cost of the thermoplastic film. Recently the cost of thermoplastic materials has risen. In response, many manufacturers attempt to control manufacturing costs by decreasing the amount of thermoplastic material in a given product.

One way manufacturers may attempt to reduce production costs is to use thinner films or stretch the thermoplastic films, thereby increasing surface area and reducing the amount of thermoplastic film needed to produce a product of a given size. Unfortunately, stretched or otherwise thinner thermoplastic films can have undesirable properties. For example, thinner thermoplastic films are typically more transparent or translucent. Additionally, consumers commonly associate thinner films with weakness. Such consumers may feel that they are receiving less value for their money when purchasing products with thinner films; and thus, may be dissuaded to purchase thinner thermoplastic films.

As such, manufacturers may be dissuaded to stretch a film or use thinner films despite the potential material savings. This is particularly the case when strength is an important feature in the thermoplastic product. For example, thermoplastic trash bags need to be puncture and tear resistant to avoid inadvertently spilling any contents during disposal. Additionally, many trash bags incorporate a drawtape to facilitate removal and disposal. Trash bags with thinner layers may fail along the seams or other areas stressed by a drawtape during removal and disposal of a trash bag.

Accordingly, continued improvement is needed to address the unique problems associated with improving trash bags while conserving the use of expensive thermoplastic materials.

BRIEF SUMMARY OF THE INVENTION

One or more implementations of the present invention provide benefits and/or solve one or more of the foregoing or other problems in the art with multi-layered thermoplastic bags with reinforced seals. The multiple layers of the thermoplastic bag can provide maintained or increased strength, while allowing for reduced thermoplastic material. Alternatively, such implementations can use a given amount of raw material and provide a bag with increased strength parameters. Furthermore, the reinforced seals can help ensure that the thermoplastic bag does not fail when stressed by a drawtape, despite the reduction in material.

For example, an implementation of a multi-layered thermoplastic bag includes a first thermoplastic bag and a second thermoplastic bag positioned with the first thermoplastic bag. The first thermoplastic bag includes first and second opposing sidewalls joined together along a first side edge, an opposite second side edge, and a bottom edge. The first and second sidewalls of the first thermoplastic bag are un-joined along at least a portion of their respective top edges to define an opening. The second thermoplastic bag includes first and second opposing sidewalls joined together along a first side edge, an opposite second side edge, and a bottom edge. The first and second sidewalls of the second thermoplastic bag are un-joined along at least a portion of their respective top edges to define an opening. The multi-layered thermoplastic bag further includes a draw tape extending along the top edges of the first and second thermoplastic bags. Additionally, the multi-layered thermoplastic bag includes at least one tape seal bonding the draw tape to the first and second thermoplastic bags. The tape seal comprises at least seven film plies bonded together.

Additionally, in another implementation, multi-layered bag includes a first sidewall comprising a first layer of a thermoplastic material and an adjacent second layer of thermoplastic material. The multi-layered bag also includes a second sidewall comprising a first layer of a thermoplastic material and an adjacent second layer of thermoplastic material. Furthermore, multi-layered bag includes a draw tape coupled to and configured to selectively draw the first and second sidewalls toward each other. First and second draw tapes coupled to and configured to selectively draw the first and second sidewalls toward each other. Additionally, a first tape seal bonds at least six plies of the first and second sidewalls to first ends of the first and second draw tapes. Similarly, a second tape seal bonds at least six plies of the first and second sidewalls to second ends of the first and second draw tapes.

In addition to the foregoing, a method of producing a multi-layered thermoplastic bag can involve inserting a first draw tape within a first hem of a first multi-layered sidewall. The method can also involve inserting a second draw tape within a second hem of a second multi-layered sidewall. Additionally, the method can involve bonding a first end of the first draw tape and a first end of the second draw tape to six or more plies of the first and second multi-layered sidewalls to form a first tape seal. Similarly, the method can involve bonding a second end of the first draw tape and a second send of the second draw tape to six or more plies of the first and second multi-layered sidewalls to form a second tape seal.

Additional features and advantages of exemplary embodiments of the present invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above recited and other advantages and features of the invention can be obtained, a more particular description of the invention briefly described above will be rendered by reference to specific embodiments thereof that are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1C:
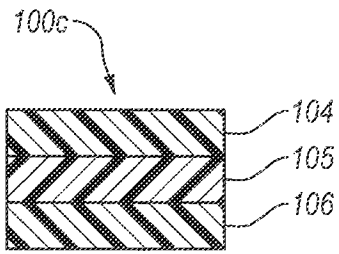
FIGS. 1A-1C illustrate views of various films structures in accordance with one or more implementations of the present invention.

One or more implementations of the present invention include multi-layered thermoplastic bags with reinforced seals. The multiple layers of the thermoplastic bag can provide maintained or increased strength, while allowing for reduced thermoplastic material. Alternatively, such implementations can use a given amount of raw material and provide a bag with increased strength parameters. Furthermore, the reinforced seals can help ensure that the thermoplastic bag does not fail when stressed by a drawtape, despite the reduction in material.

In one or more implementations the combined layers of the multi-layered bag may use less material than a conventional bag, but nonetheless have maintained or increased strength parameters provided by the layers of the bag working in concert with each other. In particular, in one or more implementations the layers of the multi-layered bag are thinner and/or stretched to reduce the amount of thermoplastic material to form a bag of a given size. For instance, one or more layers of the multi-layered bag can be continuously stretched or incrementally stretched to thin the layer and/or increase or otherwise modify the strength parameters of the layers. Suitable stretching methods include machine direction orientation ("MDO"), ring rolling, a structural elastic like film (SELF) process, embossing, or other methods.

Furthermore, at least one implementation includes a multi-layered bag having an inner bag and an outer bag. The multi-layered bag can include a drawtape running along the top of the bag to aid in closing and disposing of the multi-layered bag. The multi-layered bag can include a hem seal running along the bag just below the drawtape to enclose the drawtape. Additionally, the multi-layered bag can include tape seals to seal the ends of the draw tape to the layers of the bag.

In one or more implementations, the tape seals each include at least seven plies of thermoplastic material. For example, the tape seals can each include eight plies of thermoplastic material in one implementation. In another implementation, the tape seals can each include ten plies of thermoplastic material. In any event, the increased number of plies in the tape seal can help ensure the tape seal is sufficiently strong despite layers of reduced gauge.

Similar to the tape seals, the hem seal can include various plies of thermoplastic material. In particular, the hem seal can include at least three plies of thermoplastic material. For example, in one implementation the hem seal includes three plies of thermoplastic material, and in another implementation the hem seal includes four plies of thermoplastic material. In still further implementations, the hem seal can include more then four plies of thermoplastic material. In any event, the increased layers in the hem seal can help ensure the hem seal is sufficiently strong despite layers of reduced gauge.

As the multi-layered bags of the present invention include two or more layers, the layers can be provided with different aesthetic, material, or strength properties. For example, in one or more implementations the inner layer of the multi-layered bag can include elastic characteristics that allow the inner layer to stretch to the outer layer(s). The inner layer can include elastic characteristics either by material choice or processing (e.g., SELFing or ring rolling). Thus, the inner layer may comprise the same or different material as the outer layer(s). The inner layer may also have higher or lower strength and/or abrasion resistance than the outer layers.

In one or more implementations, the inner layer is joined or bonded to the outer layer(s) of the multi-layered bag. The joining of the inner layer to the outer layer(s) can control how much the inner layer may or may not stretch in use. For instance, to allow the inner layer to stretch freely and independently from the outer layer(s), the inner layer may be joined to the outer layer along only a hem seal near the top of the layers. Alternatively or additionally, the side edges of the inner and outer layers can be joined together. To prevent at least some stretching of the inner layer, the sidewalls of the inner layer can be laminated to the sidewalls of the outer layer(s). To allow an intermediate amount of stretching, only intermediate or discrete portions of the sidewalls of the inner layer can be laminated to the sidewalls of the outer layer(s).

Lamination of at least a portion of the inner layer to any adjacent or outer layers can be accomplished through one or more suitable techniques. For example, bonding may be achieved by pressure (for example ring rolling, stainable network lamination, or embossing), or with a combination of heat and pressure. Alternately, ultrasonic bonding can laminate the film layers. Still further, adhesives can laminate the films. Treatment with a Corona discharge can enhance any of the above methods. Prior to lamination, the separate layers can be flat film or can be subject to separate processes, such as stretching, slitting, coating and printing, and corona treatment.

In one or more implementations, the lamination between the inner layer and adjacent or outer layer(s) of a multi-layer is relatively light such that forces acting on the multi-layer film are first absorbed by breaking the bonds rather than, or prior to, tearing or otherwise causing the failure of the layers of the multi-layer bag. In particular, the bonds or bond regions of an inner layer and adjacent or outer layer(s) of multi-layer bags in accordance with one or more implementations can act to first absorb forces via breaking of the bonds prior to allowing that same force to cause failure of the individual layers of the multi-layer bag. Such action can provide increased strength to the multi-layer bag. In one or more implementations, the bonds or bond regions include a bond strength that is advantageously less than a weakest tear resistance of each of the individual films so as to cause the bonds to fail prior to failing of the film layers. Indeed, one or more implementations include bonds that the release just prior to any localized tearing of the layers of the multi-layer bag.

Thus, in one or more implementations, bonds or bond regions of a multi-layer film or bag can fail before either of the individual layers undergoes molecular-level deformation. For example, an applied strain can pull the bonds or bond regions apart prior to any molecular-level deformation (stretching, tearing, puncturing, etc.) of the individual film layers. In other words, the light bonds or bond regions can provide less resistive force to an applied strain than molecular-level deformation of any of the layers of the multi-layer film or bag. The inventors have surprisingly found that such a configuration of light bonding can provide increased strength properties to the multi-layer film or bag as compared to a film or bag with a monolayer equal thickness or a multi-layer film or bag in which the plurality of layers are tightly bonded together (e.g., coextruded).

One or more implementations of the present invention provide for tailoring the bonds or bond regions between layers of a multi-layer bag in different regions of the bag. For example, one or more implementations include modifying or tailoring one or more of bond strength, bond density, bond pattern, bond type and/or bond size of different sections of a multi-layer film or bag to deliver a bag with zones or sections with tailored strength and/or aesthetic characteristics.

As used herein, the terms "lamination," "laminate," and "laminated film," refer to the process and resulting product made by bonding together two or more layers of film or other material. The term "bonding," when used in reference to bonding of multiple layers of a multi-layer film, may be used interchangeably with "lamination" of the layers. According to methods of the present invention, adjacent layers of a multi-layer film are laminated or bonded to one another. In one or more implementations, the bonding purposely results in a relatively weak bond between the layers that has a bond strength that is less than the strength of the weakest layer of the film. This allows the lamination bonds to fail before the film layer, and thus the film, fails.

The term laminate is also inclusive of coextruded multi-layer films comprising one or more tie layers. As a verb, "laminate" means to affix or adhere (by means of, for example, adhesive bonding, pressure bonding, ultrasonic bonding, corona lamination, and the like) two or more separately made film articles to one another so as to form a multi-layer structure. As a noun, "laminate" means a product produced by the affixing or adhering just described.

The individual layers (i.e., inner and outer layers) of the multi-layer bags of one or more implementations may each themselves comprise a plurality of laminated layers. Such layers may be significantly more tightly bonded together than the bonding provided between the inner and outer layers. Both tight and relatively weak lamination can be accomplished by joining layers by mechanical pressure, joining layers with adhesives, joining with heat and pressure, spread coating, extrusion coating, and combinations thereof. Adjacent sub-layers of an individual layer may be coextruded. Co-extrusion can result in tight bonding so that the bond strength is greater than the tear resistance of the resulting laminate (i.e., rather than allowing adjacent layers to be peeled apart through breakage of the lamination bonds, the film will tear).

As used herein, the term "ply" and the plural form "plies" refers to distinct layer(s) of material. Each distinct layer of material may in turn include multiple layers of non-distinct or continuously bonded sub-layers. Examples of continuously bonded sub-layers include the sub layers of co-extruded films.

In one or more implementations, the light lamination or bonding between layers of a multi-layer bag may be non-continuous (i.e., discontinuous or partial discontinuous). As used herein the terms "discontinuous bonding" or "discontinuous lamination" refers to lamination of two or more layers where the lamination is not continuous in the machine direction and not continuous in the transverse direction. More particularly, discontinuous lamination refers to lamination of two or more layers with repeating bonded patterns broken up by repeating un-bonded areas in both the machine direction and the transverse direction of the film. Or alternatively, random bonded areas broken up by random un-bonded areas.

As used herein the terms "partially discontinuous bonding" or "partially discontinuous lamination" refers to lamination of two or more layers where the lamination is substantially continuous in the machine direction or in the transverse direction, but not continuous in the other of the machine direction or the transverse direction. Alternately, partially discontinuous lamination refers to lamination of two or more layers where the lamination is substantially continuous in the width of the article but not continuous in the height of the article, or substantially continuous in the height of the article but not continuous in the width of the article. More particularly, partially discontinuous lamination refers to lamination of two or more layers with repeating bonded patterns broken up by repeating unbounded areas in either the machine direction or the transverse direction.

Film Materials

As a preliminary matter, implementations of the present invention are described herein primarily with reference to processing and combining of thermoplastic films or webs. One will appreciate, however, that thermoplastic films or webs, are only one type of "structure" which a user may process using the components, systems, and methods described herein. For example, multi-layered bags of one or more implementations can include not only thermoplastic films, as such, but also paper, woven or non-woven fabrics, or other structures. Reference herein, therefore, to thermoplastic films or webs, as such, is primarily for convenience in description.

As used herein, the term "flexible" refers to materials that are capable of being flexed or bent, especially repeatedly, such that they are pliant and yieldable in response to externally applied forces. Accordingly, "flexible" is substantially opposite in meaning to the terms inflexible, rigid, or unyielding. Materials and structures that are flexible, therefore, may be altered in shape and structure to accommodate external forces and to conform to the shape of objects brought into contact with them without losing their integrity. In one or more implementations web materials are provided which exhibit an "elastic-like" behavior in the direction of applied strain without the use of added traditional elastic. As used herein, the term "elastic-like" describes the behavior of web materials which, when subjected to an applied strain, the web materials extend in the direction of applied strain, and when the applied strain is released the web materials return, to a degree, to their pre-strained condition.

Indeed, implementations of the present invention can include any flexible or pliable thermoplastic material that may be formed or drawn into a web or film. Furthermore, the thermoplastic materials may include a single layer or multiple non-distinct layers. Examples of multi-layered films suitable for use with one or more implementations of the present invention include coextruded multi-layered films, multiple films continuously laminated together, and multiple films partially or discontinuously laminated together. The thermoplastic material may be opaque, transparent, translucent, or tinted. Furthermore, the thermoplastic material may be gas permeable or impermeable.

The films of one or more implementations of the present invention can have a starting gauge between about 0.1 mils to about 20 mils, suitably from about 0.2 mils to about 4 mils, suitably in the range of about 0.3 mils to about 2 mils, suitably from about 0.6 mils to about 1.25 mils, suitably from about 0.9 mils to about 1.1 mils, suitably from about 0.3 mils to about 0.7 mils, and suitably from about 0.4 mils and about 0.6 mils. In further implementations, the starting gauge of the films may be greater than about 20 mils. Additionally, the starting gauge of films of one or more implementations of the present invention may not be uniform. Thus, the starting gauge of films of one or more implementations may vary along the length and/or width of the film.

Figure 1B:
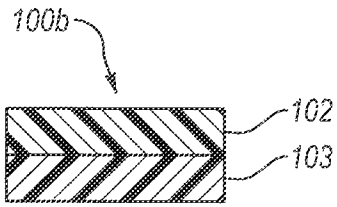
Figure 1A:
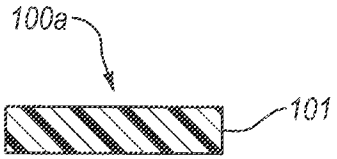

FIG. 1A illustrates a film ply 100*a* of a single layer 101. In another implementation, as illustrated by FIG. 1B, a film ply 100*b* can have multiple sub-layers (i.e., a bi-layered film). In particular, the film ply 100*b* can include a first sub layer 102 and a second sub layer 103. The first and second sub layers 102, 103 can optionally include different grades of thermoplastic material or include different additives, including polymer additives. In still another implementation, shown in FIG. 1C, a film ply 100*c* can include three sub layers (i.e., a tri-layered film). For example, FIG. 1C illustrates that the film 100*c* can include a first sub layer 104, a second sub layer 105, and a third sub layer 106.

As described above, the films 100*a*-100*l* referred to herein may include one layer or a plurality of thermoplastic sub layers. In addition to thermoplastic materials, the films 100*a*-100*l* can include additives, as desired (e.g., pigments, slip agents, anti-block agents, tackifiers, or combinations thereof). The thermoplastic material of the film 100*a*-100*l* of one or more implementations can include, but are not limited to, thermoplastic polyolefins, including polyethylene, polypropylene, and copolymers thereof. Besides ethylene and propylene, exemplary copolymer olefins include, but are not limited to, ethylene vinylacetate (EVA), ethylene methyl acrylate (EMA) and ethylene acrylic acid (EAA), or blends of such olefins. Various other suitable olefins and polyolefins will be apparent to one of skill in the art.

In at least one implementation, such as shown in FIG. 1C, a multilayered film 100*c* can include co-extruded layers. For example, the film 100*c* can include a three-layer B:A:B structure, where the ratio of sub layers can be 20:60:20. The exterior B sub layers (i.e., 104, 106) can comprise a mixture of hexene LLDPE of density 0.918, and metallocene LLDPE of density 0.918. The interior A core layer (105) can comprise a mixture of hexene LLDPE of density 0.918, butene LLDPE of density 0.918, reclaimed resin from trash bags. Additionally, the A core sub layer 105 can optionally include a colorant containing carbon black, resulting in a black colored film.

In another implementation, the film 100*c* is a coextruded three-layer B:A:B structure, where the ratio of sub layers is 20:60:20. The exterior B sub layers (104, 106) can comprise hexene LLDPE of density 0.918, and metallocene LLDPE of density 0.918. The interior A core sub layer (105) can comprise hexene LLDPE of density 0.918, metallocene LLDPE of density 0.918, butene LLDPE of density 0.918, reclaimed resin from trash bags. The A core sub layer 105 can also include a processing aide, colorant containing carbon black, and colorant containing white TiO2, resulting in a grey colored film. In some implementations, the carbon black or reclaimed resin can be omitted, resulting in a white colored film.

In another example, the film 100*c* is a coextruded three-layer B:A:B structure where the ratio of sub layers is 15:70:15. The A core sub layer 105 can comprise a LLDPE material, and the B outer sub layers 104, 106 can include added C6 olefin LLDPE. The LLDPE material can have a MI of 1.0 and density of 0.920 g/cm$^3$. The B:A:B structure can also optionally have a ratio of B:A that is greater than 20:60 or less than 15:70. In one or more implementations, the LLDPE can comprise greater than 50% of the overall thermoplastic material in the film 100*c*.

In another example, the film 100*c* is a coextruded three-layer C:A:B structure where the ratio of sub layers is 20:60:20. The C sub layer 104 can comprise a LLDPE material with a first colorant (e.g., black). The B sub layer 106 can also comprise a LLDPE material with a second colorant (e.g., white). The LLDPE material can have a MI of 1.0 and density of 0.920 g/cm3. The A core sub layer 105 can comprise similar materials to any of the core sub layer describe above.

As explained in below, this film structure can allow for a bag-in-bag with an outer surface or layer of black and an inner surface or layer of white.

In at least one implementation of the present invention, the film 100*a*-100*l* can preferably include linear low-density polyethylene. The term "linear low density polyethylene" (LLDPE) as used herein is defined to mean a copolymer of ethylene and a minor amount of an alkene containing 4 to 10 carbon atoms, having a density of from about 0.910 to about 0.926 g/cm3, and a melt index (MI) of from about 0.5 to about 10. For example, one or more implementations of the present invention can use an octene co-monomer, solution phase LLDPE (MI=1.1; ρ=0.920). Additionally, other implementations of the present invention can use a gas phase LLDPE, which is a hexene gas phase LLDPE formulated with slip/AB (MI=1.0; ρ=0.920). One will appreciate that the present invention is not limited to LLDPE, and can include "high density polyethylene" (HDPE), "low density polyethylene" (LDPE), and "very low density polyethylene" (VLDPE). Indeed films made from any of the below mentioned thermoplastic materials or combinations thereof can be suitable for use with the present invention.

Such thermoplastic materials can include, but are not limited to, thermoplastic polyolefins, including polyethylene and copolymers thereof and polypropylene and copolymers thereof. The olefin-based polymers including ethylene or propylene based polymers such as polyethylene, polypropylene, and copolymers such as ethylene vinyl acetate (EVA), ethylene methyl acrylate (EMA) and ethylene acrylic acid (EAA), or blends of such polyolefins. Other examples of polymers suitable for use as films include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly (styrene-butadiene-styrene), poly(styrene-isoprene-styrene), poly(styrene-ethylene-butylene-styrene), poly(ester-ether), poly(ether-amide), poly(ethylene-vinyl acetate), poly(ethylene-methyl acrylate), poly(ethylene-acrylic acid), poly(ethylene butyl acrylate), polyurethane, poly(ethylene-propylene-diene), ethylene-propylene rubber.

Other examples of polymers suitable for use as films in accordance with the one or more implementations of the present invention include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinyl acetate), poly(ethylene-methyl acrylate), poly(ethylene-acrylic acid), poly(ethylene butyl acrylate), polyurethane, poly(ethylene-propylene-diene), ethylene-propylene rubber, and combinations thereof.

In addition to the foregoing, one will appreciate in light of the disclosure herein that manufacturers may form the films or webs using a wide variety of techniques. For example, a manufacturer can form the films using conventional flat or cast extrusion or co-extrusion to produce monolayer, bi-layer, or multi-layer films. Alternatively, a manufacturer can form the films using suitable processes, such as, a blown film process to produce monolayer, bi-layer, or multi-layer films. If desired for a given end use, the manufacturer can orient the films by trapped bubble, tenterframe, or other suitable process. Additionally, the manufacturer can optionally anneal the films.

In one or more implementations, the films of the present invention are blown film, or cast film. Blown film and cast film is formed by extrusion. The extruder used can be a conventional one using a die, which will provide the desired gauge. Some useful extruders are described in U.S. Pat. Nos. 4,814,135; 4,857,600; 5,076,988; 5,153,382, each of which are incorporated herein by reference. Examples of various extruders, which can be used in producing the films to be used with the present invention, can be a single screw type modified with a blown film die, an air ring, and continuous take off equipment.

In one or more implementations, a manufacturer can use multiple extruders to supply different melt streams, which a feed block can order into different channels of a multi-channel die. The multiple extruders can allow a manufacturer to form a multi-layered film with layers having different compositions. In a blown film process, the die can be an upright cylinder with a circular opening. Rollers can pull molten plastic upward away from the die. An air-ring can cool the film as the film travels upwards. An air outlet can force compressed air into the center of the extruded circular profile, creating a bubble. The air can expand the extruded circular cross section by a multiple of the die diameter. This ratio is called the "blow-up ratio." When using a blown film process, the manufacturer can collapse the film to double the plies of the film. Alternatively, the manufacturer can cut and fold the film, or cut and leave the film unfolded.

Figure 2A:
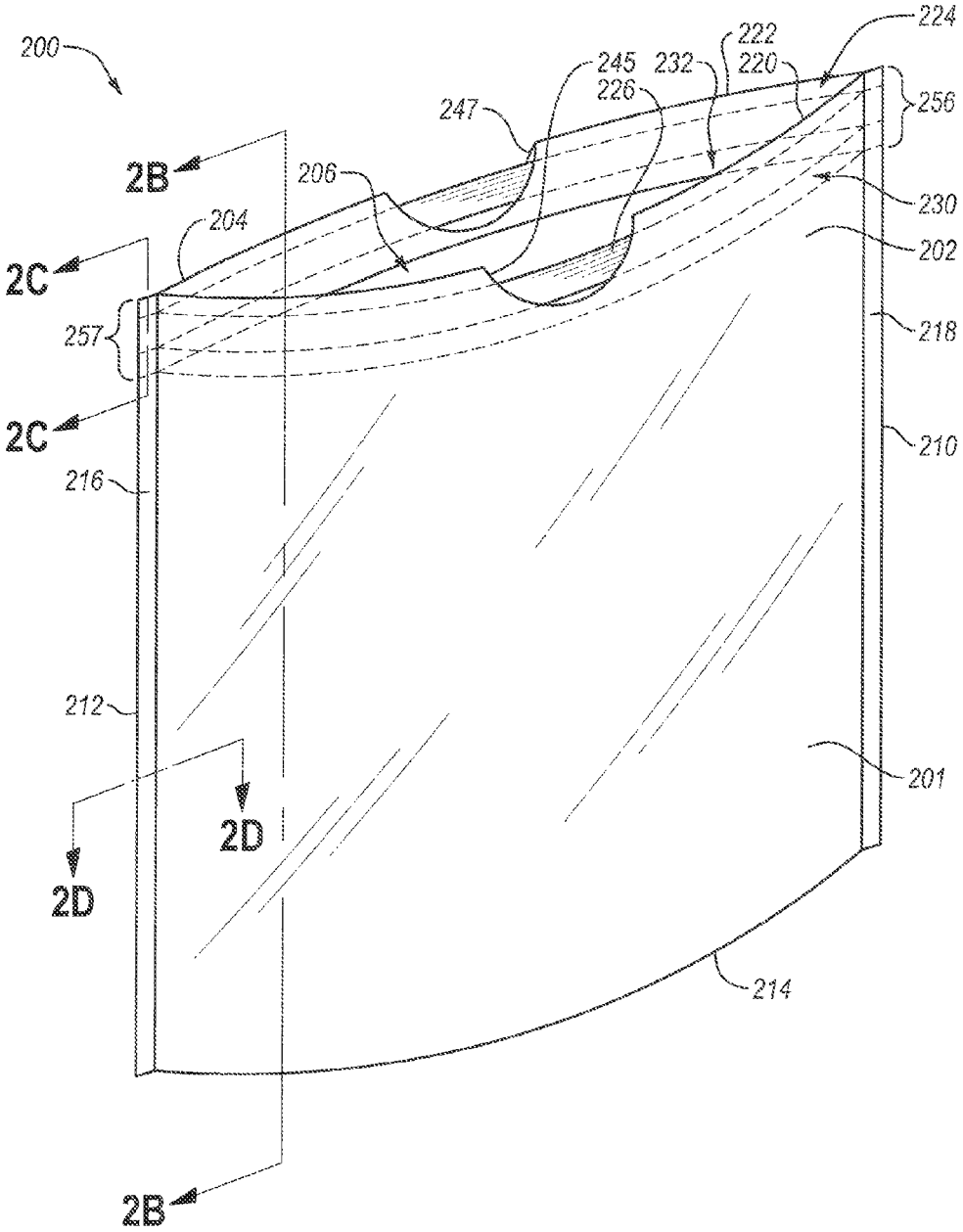
FIG. 2A illustrates a perspective view of a multi-layered thermoplastic bag with reinforced seals in accordance with one or more implementations of the present invention.
Figure 2B:
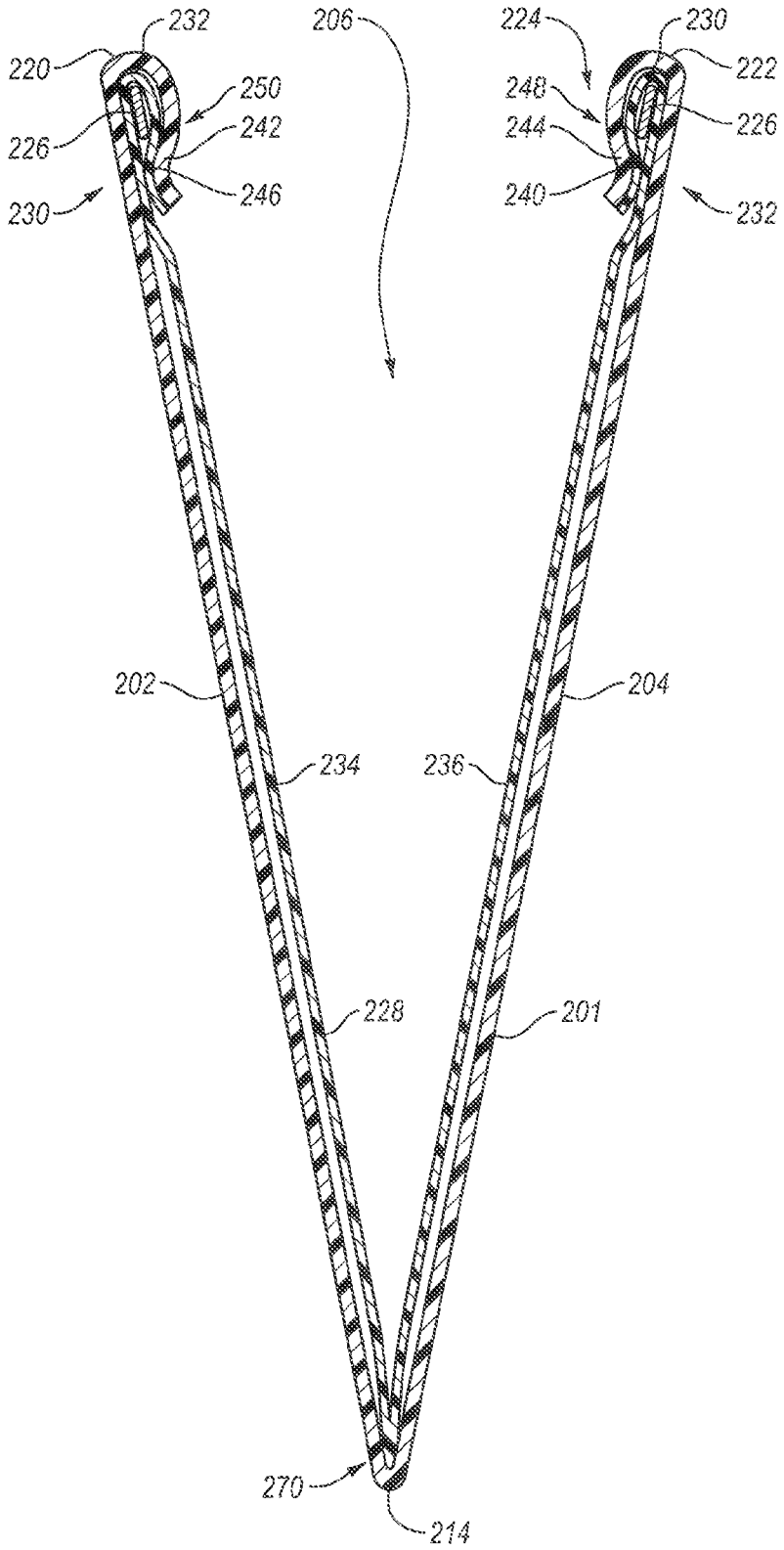
FIG. 2B illustrates a cross-sectional view of the multi-layered thermoplastic bag of FIG. 2A taken along the section line 2B-2B of FIG. 2A.

Referring to FIGS. 2A and 2B, an implementation of multi-layered thermoplastic bag 200 with reinforced seals is illustrated. While the multi-layered bags of one or more implementations are generally capable of holding a vast variety of different contents, the multi-layered bag 200 illustrated in FIGS. 2A and 2B may be intended to be used as a liner for a garbage can or similar refuse container. The multi-layered thermoplastic bag 200 can include an outer layer or outer bag 201 including a first sidewall 202 and a second sidewall 204. The first and second sidewalls 202, 204 may have matching rectangular or square shapes.

To allow access to the interior volume of the multi-layered bag 200 at least a portion of the top edges 220, 222 of the first and second sidewalls 202, 204 may be un-joined to define an opening 224. The opening 224 can be opposite the bottom edge 214. When placed in a trash receptacle, the top edges 220, 222 of the first and second sidewalls 202, 204 may be folded over the rim of the receptacle.

The multi-layered bag 200 also optionally includes a closure mechanism located adjacent to, or along, the upper edges 220, 222 for closing the top of the multi-layered bag 200 to form a fully-enclosed container or vessel. As shown by FIGS. 2A and 2B, the closure mechanism can comprise a draw tape 226. To access the draw tape 226, first and second notches 245, 247 (FIG. 2A) may be disposed through the respective first and second top edges 220, 222. Pulling the draw tape 226 through the notches 245, 247 can constrict the first and second top edge 220, 222 thereby closing or reducing the opening 224.

As previously mentioned, the multi-layered bag 200 further includes an inner layer or inner bag 228 as best shown by FIG. 2B. The inner layer or bag 228 can include a first sidewall 234 and a second sidewall 236. As shown, the inner layer or bag 228 is positioned within the first layer or bag 201. Such a configuration may be considered a "bag-in-bag" configuration. In other words the multi-layered bag 200 can include a second thermoplastic layer or bag 228 positioned within a first thermoplastic layer or bag 201. Each of the first (i.e., outer) and second (i.e., inner) layers or bags 201, 228 can include a pair of opposing sidewalls joined together along three edges.

The multi-layered bag 200 can also be considered as a bag with multi-layered sidewalls. For example, the first sidewalls 202, 234 of the first and second layers or bags 201, 228 can be considered a first sidewall of the multi-layered bag 200. Similarly, the second sidewalls 204, 236 of the first and second layers or bags 201, 228 can be considered a second sidewall of the multi-layered bag 200.

Each of the sidewalls 202, 204, 234, 236 (or in other words each of the inner and outer layers or bags 201, 228) can have a gauge or thickness (i.e., average distance between the major surfaces) between about 0.1 mils to about 10 mils, suitably from about 0.1 mils to about 4 mils, suitably in the range of about 0.1 mils to about 2 mils, suitably from about 0.1 mils to about 1.25 mils, suitably from about 0.9 mils to about 1.1 mils, suitably between about 0.2 mils to about 0.9 mils, and suitably between about 0.3 mils to about 0.7 mils. Additionally, as shown by FIG. 2B, the sidewalls 202, 204 may be thicker than the sidewalls 234, 236. In alternative implementations, the sidewalls 202, 204 can have a thickness approximately equal to the thickness of the sidewalls 234, 236. In yet further implementations, the sidewalls 202, 204 may be thicker than the sidewalls 234, 236.

As shown in FIG. 2B, each of the sidewalls 202, 204, 234, 236 can have a uniform or consistent gauge. In alternative implementations, one or more of the sidewalls 202, 204, 234, 236 can be rough or uneven. Further, the gauge of one or more of the sidewalls 202, 204, 234, 236 need not be consistent or uniform. Thus, the gauge of one or more of the sidewalls 202, 204, 234, 236 can vary due to product design, manufacturing defects, tolerances, or other processing issues.

In particular, in one or more implementations one or more of the sidewalls 202, 204, 234, 236 is incrementally stretched as explained in greater detail below. For example, in one or more implementations one or more of the film layers 202, 204, 234, 236 is incrementally stretched by one or more of MD ring rolling, transverse direction TD ring rolling, SELFing, or other methods. Incrementally stretching one or more of the sidewalls 202, 204, 234, 236 can increase or otherwise modify one or more of the tensile strength, tear resistance, impact resistance, or elasticity of the films, while also reducing the basis weight of the film.

The sidewalls or layers 202, 204, 234, 236 can each comprise films of thermoplastic material. In particular, the sidewalls or layers 202, 204, 234, 236 can comprise any of the thermoplastic materials described hereinabove, or combinations thereof. For example, the sidewalls 202, 204, 234, 236 can comprise any of the film structures described above in relation to FIGS. 1A-1C or any of the other thermoplastic materials described above. In one or more implementations, the sidewalls 202, 204 can comprise the same thermoplastic material as the sidewalls 234, 236. In alternative implementations, the sidewalls 202, 204 can comprise a different thermoplastic material than the sidewalls 234, 236. For example, the material of the sidewalls 234, 236 may have a higher tensile strength, tear resistance, puncture resistance, elasticity, and/or abrasion resistance than the material of the sidewalls 202, 204, or vice versa. Sidewalls 234, 236 made of stronger and/or tougher material may help further protect the multi-layered bag 200 against rupture and/or puncture.

In addition to the forgoing, in one or more implementations the sidewalls or layers 202, 204, 234, 236 can comprise the same color. In alternative implementations, the color of the inner sidewalls 234, 236 can differ from the color of the outer sidewalls 202, 204. For example, in one or more implementations the outer sidewalls 202, 204 can comprise a white, translucent thermoplastic material. The inner sidewalls 234, 236 can comprise a pigmented (i.e., non-white) thermoplastic material. For example, in one or more implementations the sidewalls 234, 236 can comprise a black thermoplastic material.

In such implementations, the areas of the multi-layered bag 200 reinforced by the inner sidewalls 234, 236 can appear gray when view from the outside of the multi-layered bag 200. Thus, the differing color of the multi-layered bag 200 reinforced by the inner layer 228 can serve to notify a consumer that the multi-layered bag 200 is reinforced. In alternative implementations, the outer layer or bag 202 can comprise a black thermoplastic material, and the inner layer or bag 228 can comprise a white thermoplastic material.

Additionally, as shown by FIGS. 2A and 2B, the multi-layered bag 200 includes multiple layers. FIGS. 2A and 2B illustrate a multi-layered bag 200 with two layers. One will appreciate in light of the disclosure herein that in alternative implementations one or more multi-layered bags of the present invention can include more than two layers. For example, multi-layered bags of one or more implementations can include 3, 4, 5, 6, or more layers.

The length of the multi-layered bag 200 may have a first range of about 20 inches (50.8 cm) to about 48 inches (121.9 cm), a second range of about 23 inches (58.4 cm) to about 33 inches (83.8 cm), and a third range of about 26 inches (66 cm) to about 28 inches (71.1 cm). In one implementation, the length may be 27.375 inches (69.5 cm). In alternative implementations, the length may be shorter or longer than the examples listed above.

Referring again to FIGS. 2A and 2B, to accommodate the draw tape 226 the first top edge 220 of the first sidewalls 202, 234 may be folded back into the interior volume 206 and may be attached to the interior surface of the inner sidewall 234 to form a first hem 250. Similarly, the second top edge 222 of the second sidewalls 204, 236 may be folded back into the interior volume and may be attached to the inner sidewall 234 to form a second hem 248. As shown by FIG. 2B, in one or more implementations, the draw tape 226 extends loosely through the first and second hems 250, 248 along the first and second top edges 220, 222.

More specifically, to accommodate the draw tape 226, referring to FIGS. 2A and 2B, the top edges 220, 222 of the first and second sidewalls 202, 204 of the outer bag 201 corresponding to the periphery of the opening 224 may include respective first and second hem flaps 242, 244. Similarly, the top edges 220, 222 of the first and second sidewalls 234, 236 of the inner bag 228 may include respective first and second hem flaps 240, 246. The hem flaps 240, 246 of the inner bag 228 may be folded back into the interior volume 206 and attached to the interior surface of the first sidewall 236 of the inner bag 228 at hem seals 230, 232. Similarly, the hem flaps 244, 242 of the outer bag 201 may be folded back into the interior volume 206 and attached to the exterior surface of the hem flaps 240, 246 of the inner bag 201.

Thus, in one or more implementations each of the hem seals 230, 232 can comprise at least three plies of thermoplastic material. For example, FIG. 2B illustrates that the hem seals include four plies each. One will appreciate in light of the disclosure herein that the having four plies of thermoplastic film in the hem seals 230, 232 can help provide adequate material for forming a strong seal, despite the fact that the individual layers, or even the layers as a whole, my be thinner or include less material than conventional thermoplastic bags. Additionally, as each hem flap includes two plies of thermoplastic material, the bag 200 can help ensure that the draw tape 226 is not pulled out from the hem flaps.

The hem seals 230, 232 can be continuous in one or more implementations. In other words, as shown by FIG. 2A, the hem seals 230, 232 can extend from the first side edge 210 to the opposing second side edge 212. In alternative implementations, the hem seals can be non-continuous or intermittent. Intermittent hem seals 230, 232 can allow air to escape from between the inner bag 238 and the outer bag 201 during manufacture or use. One will appreciate in light of the disclosure herein, the ability for air to escape can provide a number of advantages, including but not limited to, thickness of the bag 200 during packaging or otherwise.

The hem flaps may be attached to the surfaces of the sidewalls by adhesive, heat seals or otherwise. In other implementations, the hem seals 230, 232 can be formed on the exterior of the sidewalls instead of the interior. In such implementations, a manufacturer can fold the hem flaps 240, 242, 244, 246 toward the exterior of the bag 200 and bond or attach them to the sidewall exterior surface 202, 204. In still further implementations, the hems may be formed as separate elements that are attached to the sidewalls.

As shown in FIG. 2B, the draw tape 226 can be within the hems 248, 250 and adjacent to, or abutting against, the first and second hem flaps 240, 246 of the inner bag 228. Furthermore, the draw tape 226 may not abut against or, or be adjacent to, the first and second hem flaps 242, 244 of the outer bag 201. As shown by FIG. 2A, the draw tape 226 can pass through two or more notches 245, 247, where at the notches there may be two or more folded plies of material (FIG. 2B).

The first and second sidewalls 202, 204 of the outer bag 201 and the first and second sidewalls 234, 236 of the inner bag 228 can be joined together along a first side edge 210 by a first side seal 218, such as a heat seal. A second side seal 216 can join an opposing second side edge 212 together (i.e., the other sides of the first and second sidewalls 202, 204 of the outer bag 201 and the other sides of first and second sidewalls 234, 236 of the inner bag 228). A bottom edge 214 can extend between the first and second side edges 210, 212 and similarly join the first and second sidewalls 202, 204 together. In one or more implementations, the bottom edge 214 can comprise a fold. In other words, the first and second sidewalls 202, 204 can comprise a single film or layer folded in half.

Figure 2C:
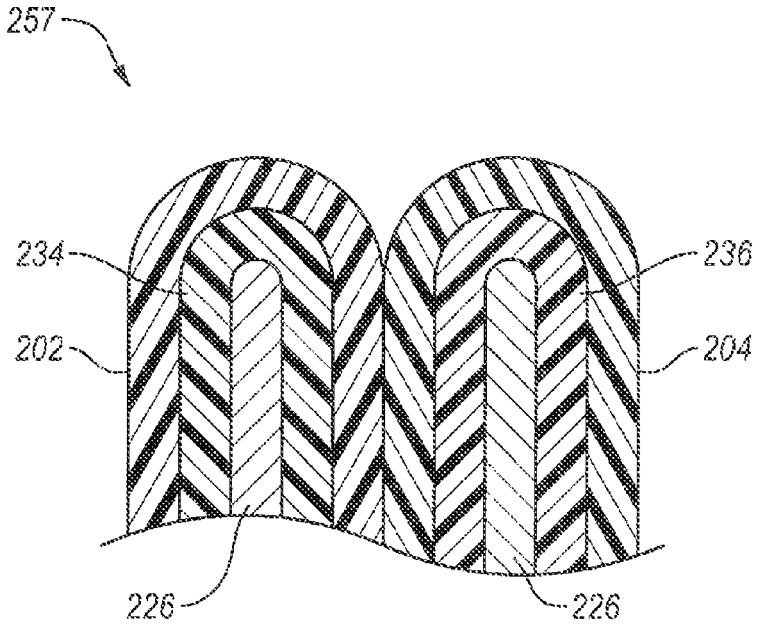
FIG. 2C illustrates a cross-sectional view of the multi-layered thermoplastic bag of FIG. 2A taken along the section line 2C-2C of FIG. 2A.

In alternative implementations, one of the first and second side edges 210, 212 can comprise a fold instead of a seal. Similarly, in one or more implementations, a bottom seal can join the bottoms of the first and second sidewalls 202, 204 instead of a fold. For example, FIG. 3 illustrates a multi-layered bag 200*a*, similar the bag 200 shown in FIGS. 2A-2D albeit that a bottom seal 270 that joins the bottom edges of the first and second sidewalls 202, 204 together.

The sidewalls or layers 202, 204, 234, 236 may be joined along their edges to form side seals 216, 218 using any suitable joining process such as, for example, heat sealing in which the thermoplastic material bonds or melts together. Other sealing or joining processes may include ultrasonic methods and adhesive.

Figure 2D:
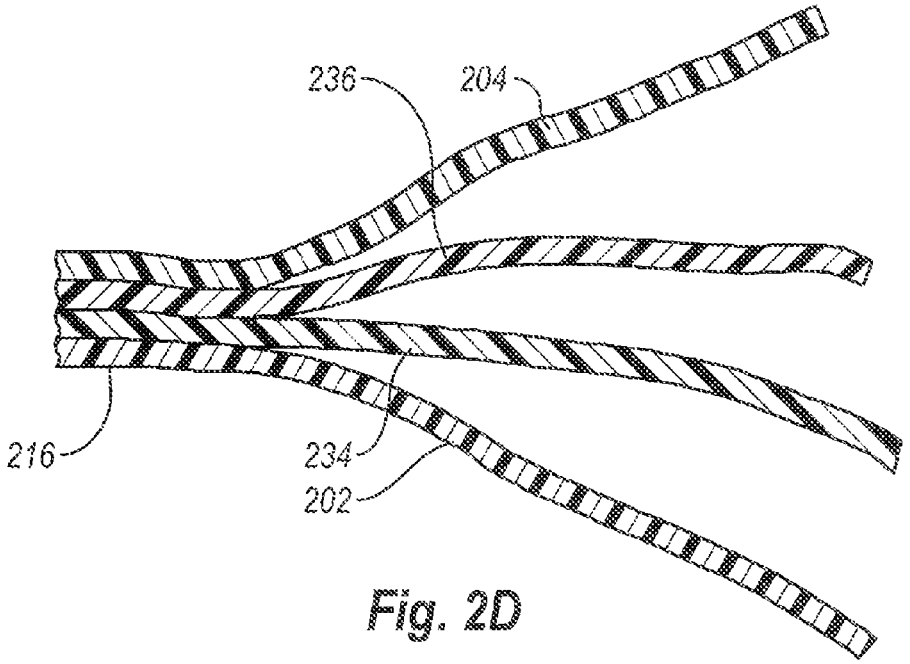
FIG. 2D illustrates a cross-sectional view of the multi-layered thermoplastic bag of FIG. 2A taken along the section line 2D-2D of FIG. 2A.
Figure 3:
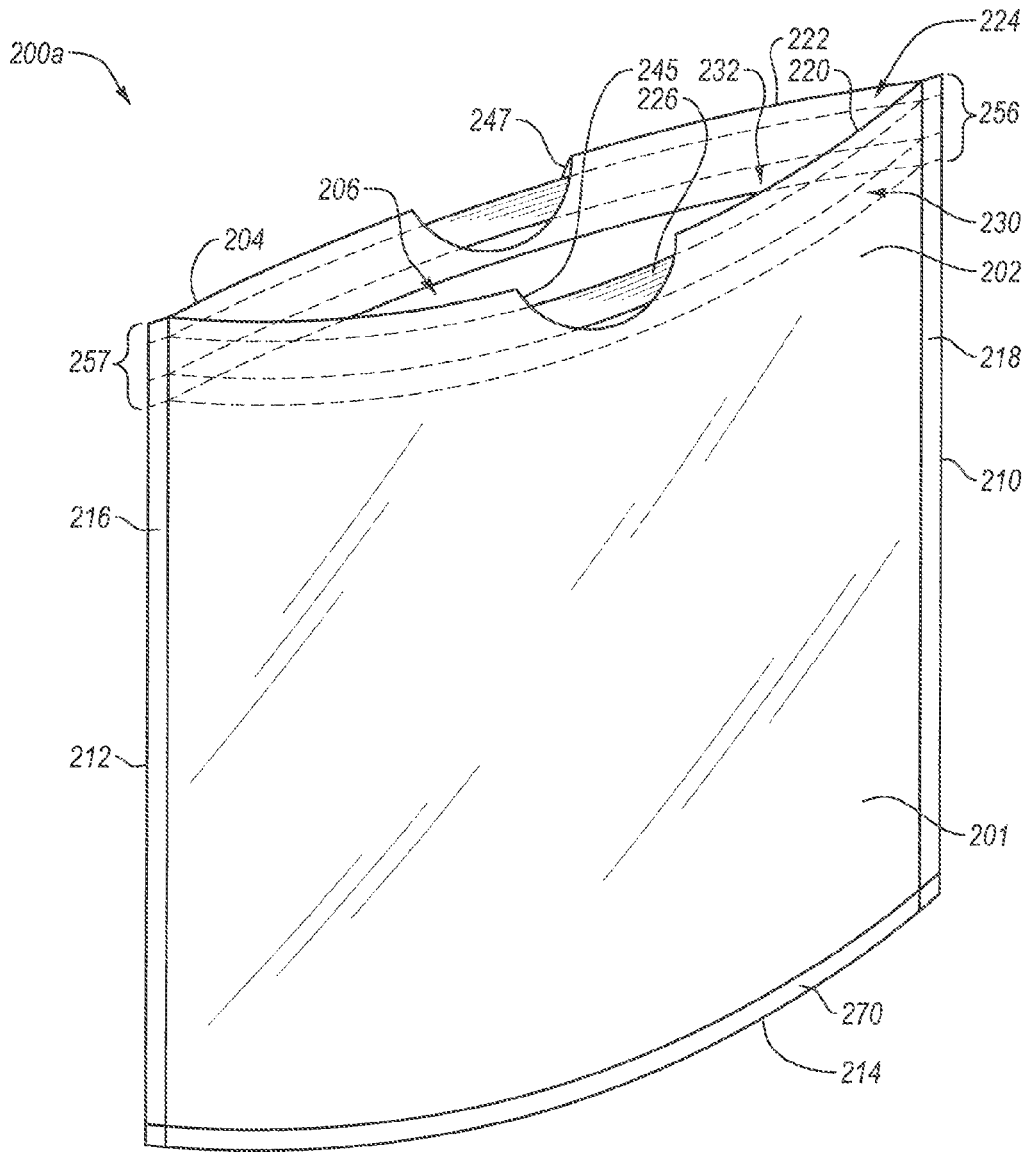
FIG. 3 illustrates a perspective view of another multi-layered thermoplastic bag with reinforced seals in accordance with one or more implementations of the present invention.

A cross-sectional view of the side seal 216 is illustrated by FIG. 2D. As shown, the side seal 216 can comprise four plies joined together. In particular, the four plies of the side seal 216 can comprise the first and second sidewalls 202, 204 of the outer bag 201 and the first and second sidewalls 234, 236 of the inner bag 228. One will appreciate in light of the disclosure herein that the having four plies of thermoplastic film in the side seals 216, 218 can help provide adequate material for forming a strong seal, despite the fact that the individual layers, or even the layers as a whole, my be thinner or include less material than conventional thermoplastic bags.

In addition to the side seals 216, 218, the multi-layered bag 200 can further include tape seals 256, 257. The tape seals 256, 257 can seal the draw tape 226 to one or more layers of the inner or outer bags 201, 228. FIG. 2C illustrates a cross-sectional view of the tape seal 257. As shown, the tape seal 257 (and similarly tape seal 256) can comprise seven or more plies. For example, as shown by FIG. 2C, in one or more implementations the tape seal 257 can comprise ten plies of material. In particular, the tape seal 257 in FIG. 2C includes the outer sidewall 202 bonded to the inner sidewall 234; the inner sidewall 234 bonded to the draw tape 226; the draw tape 226 bonded to the inner sidewall 234; the inner sidewall 234 bonded to the outer sidewall 202; the outer sidewall 202 bonded to the outer sidewall 204; the outer sidewall 204 bonded to the inner sidewall 236; the inner sidewall 236 bonded to the draw tape 226; the draw tape 226 bonded to the inner sidewall 236; and the inner sidewall 236 bonded to the outer sidewall 204.

As shown by FIG. 2C the first sidewalls 202, 234 can each be folded over the draw tape 226 so as to be included twice in the tape seal 257 (i.e., on both sides of the draw tape 226). Similarly, the second sidewalls 204, 236 can each be folded over the draw tape 226 so as to be included twice in the tape seal 257 (i.e., on both sides of the draw tape 226). In other words, the tape seals 257 can comprise first and second portions of each of the first sidewalls 202, 234 and the second sidewalls 204, 236.

Thus, the folding of the sidewalls 202, 204, 234, 236 can not only provide for a reinforced hem, but also a reinforced tape seal 257. The additional plies in the tape seals 256, 257 can help ensure that the tape seals 256, 257 are adequately strong to prevent failure, such as the draw tape 226 being pulled out of the notches 245, 247 (FIG. 2A). One will appreciate in light of the disclosure herein that the having seven or more plies of thermoplastic film in the tape seals 257, 256 can help provide adequate material for forming a strong seal, despite the fact that the individual layers, or even the layers as a whole, my be thinner or include less material than conventional thermoplastic bags.

In addition to the foregoing, in one or more implementations, the inner layer or bag 228 is joined or bonded to the outer layer or bag 201 of the multi-layered bag 200. For example, FIGS. 2A-2D illustrates that in one implementation the inner layer or bag 228 is joined to the outer layer or bag 201 along the hem seals 230, 232 and the side seals 216, 218. One will appreciate in light of the disclosure herein that heat seals or other mechanisms bonding the side edges 212, 210 of the inner and outer layers or bags 201, 228 together can restrict or prevent at least some stretching of the inner layer or bag 228 relative to the outer bag 201.

In alternative implementations, the inner layer or bag 228 can additionally, or alternatively, be joined to the outer layer or bag 201 only along the hem seams 230, 232. Thus, the inner layer or bag 228 can expand or stretch freely relative to the outer layer or bag 201. In such implementations, the inner layer or bag 228 can act independently of the outer layer or bag 201. In particular, the inner layer or bag 228 can act as a shock absorber and absorb forces associated with loading the multi-layered bag 200.

In addition to the foregoing, in one or more implementations one or more of the sidewalls 234, 236 of the inner layer or bag 228 can be laminated to the respective sidewalls 202, 204 of the outer layer or bag 201. For example, the sidewalls 234, 236 of the inner layer or bag 228 can be continuously bonded to the sidewalls 202, 204 of the outer layer or bag 201.

For example, the inner and outer layers or bags 201, 228 can be co-extruded, joined shortly after extrusion while still tacky, adhesively bonded, or otherwise continuously bonded.

In alternative implementations the inner layer or bag 228 is non-continuously laminated to the outer layer or bag 201. For example, the inner layer or bag 228 can be non-continuously laminated to the outer layer or bag 201 using any of the methods, process, and techniques described in U.S. patent application Ser. No. 13/273,384 filed on Oct. 14, 2011, the entire contents of which are hereby incorporated by reference. For example, the inner layer or bag 228 can be non-continuously laminated to the outer layer or bag 201 using a process selected from the group consisting of adhesive bonding, ultrasonic bonding, embossing, ring rolling, SELFing, and combinations thereof.

In at least one implementation, the lamination between the inner and outer layers or bags 201, 228 can have a bond strength that is less than a weakest tear resistance of each of the inner and outer layers or bags 201, 228 so as to cause the lamination to fail prior to failing of the inner and outer layers or bags 201, 228. Indeed, one or more implementations include bonds that the release just prior to any localized tearing of the inner and outer layers or bags 201, 228. In particular, the lamination between the inner and outer layers or bags 201, 228 can act to first absorb forces via breaking of the bonds prior to allowing that same force to cause failure of the inner and outer layers or bags 201, 228. Such action can provide increased strength to the multi-layered bags of one or more implementations of the present invention.

Thus, in one or more implementations, strains applied to a multi-layered bag with a shortened inner layer can first be at least partially absorbed or softened by breaking of the bond(s) between the inner layer or bag and the outer layer or bag. Thereafter, the shortened inner bag can absorb forces and stretch to the size of the outer bag(s) before the outer bag(s) is significantly strained. Once stretched the inner bag can work in concert with the outer bag(s) to provide strength. Such implementations can provide an overall bag employing a reduced amount of raw material that nonetheless has maintained or increased strength parameters.

In addition to the foregoing, the bonds between the inner and outer layers can allow the inner layer or bag to act as a shock absorber by de-bonding from the outer layer or bag as articles, such as trash, are added to the bag. This de-bonding may allow the inner layer or bag to expand, stretch, or otherwise move downward. This de-bonding may also allow the inner layer or bag to separate in areas away for the added article and thus absorb some of the energy.

This is beneficial as it has been found that thermoplastic films often exhibit strength characteristics that are approximately equal to the strength of the weakest layer. Providing relatively weak bonding between the inner and outer layers or bags 201, 228 has surprisingly been found to greatly increase the strength provided by the inner layer or bag 228. As more explicitly covered in U.S. patent application Ser. No. 12/947,025 filed Nov. 16, 2010 and entitled DISCONTINUOUSLY LAMINATED FILM, incorporated by reference herein, the MD and TD tear values of non-continuously laminated films in accordance with one or more implementations can exhibit significantly improved strength properties, despite a reduced gauge. In particular, the individual values for the Dynatup, MD tear resistance, and TD tear resistance properties in non-continuously laminated films of one or more implementations are unexpectedly higher than the sum of the individual layers. Thus, the non-continuous lamination of the inner and outer layers or bags 201, 228 can provide a synergistic effect.

More specifically, the TD tear resistance of the non-continuously laminated films can be greater than a sum of the TD tear resistance of the individual layers. Similarly, the MD tear resistance of the non-continuously laminated films can be greater than a sum of the MD tear resistance of the individual layers. Along related lines, the Dynatup peak load of the non-continuously laminated films can be greater than a sum of a Dynatup peak load of the individual layers. Thus, the non-continuously laminated films can provide a synergistic effect. In addition to the foregoing, one or more implementations of a non-continuously laminated multi-layered bag with a shortened inner layer can allow for a reduction in basis weight (gauge by weight) as much as 50% and still provide enhanced strength parameters.

Figure 4A:
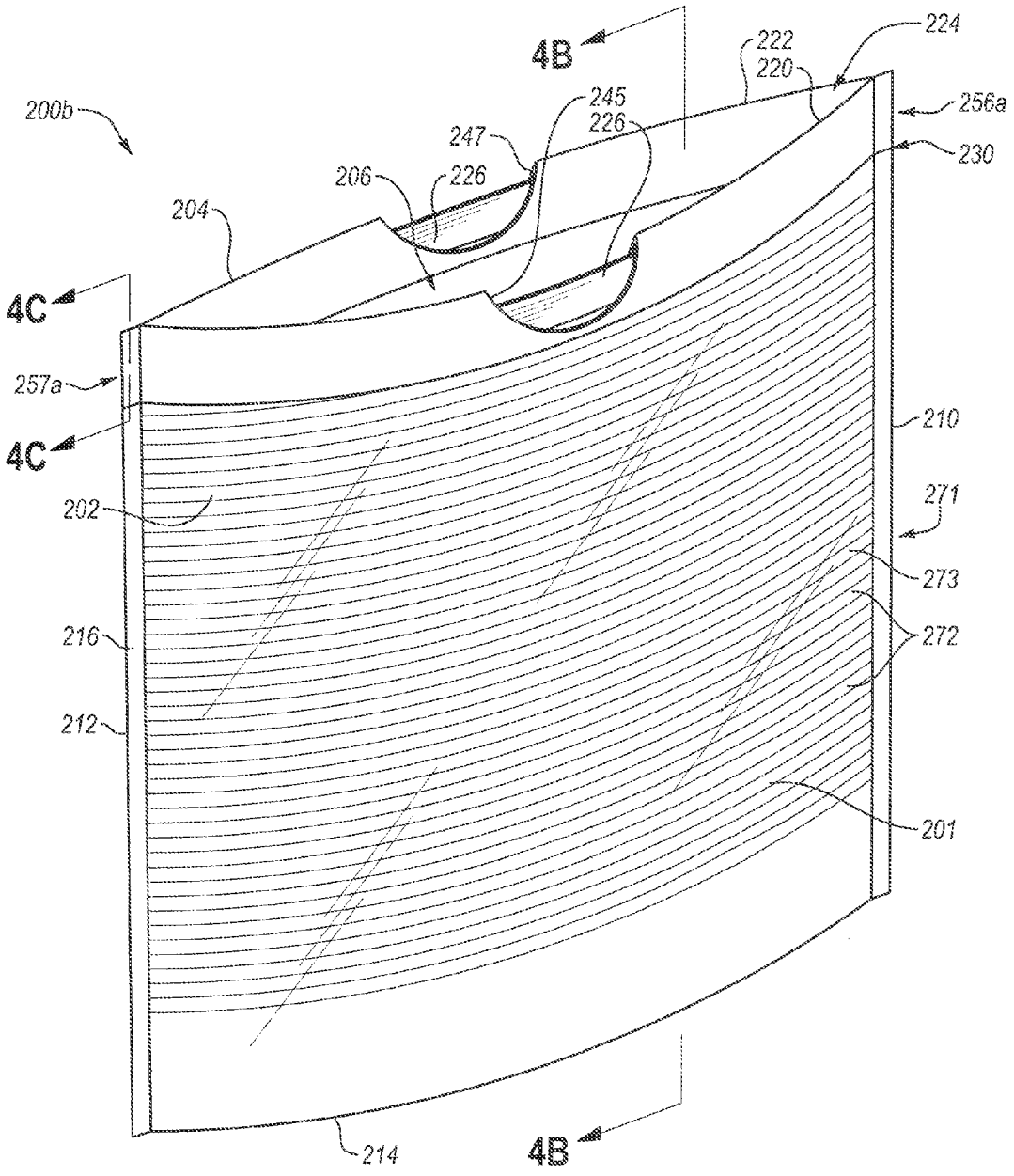
FIG. 4A illustrates a perspective view of yet another multi-layered thermoplastic bag with reinforced seals in accordance with one or more implementations of the present invention.
Figure 4B:
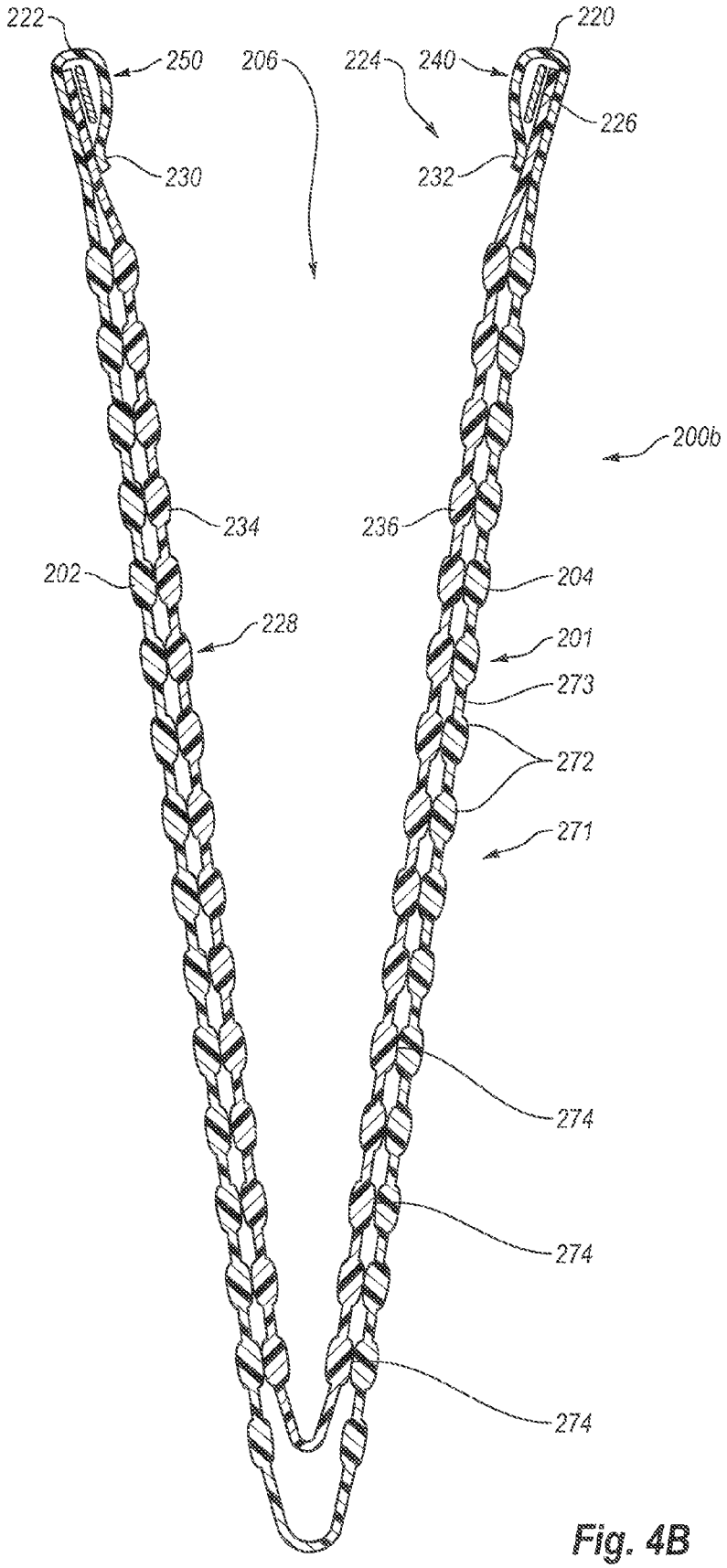
FIG. 4B illustrates a cross-sectional view of the multi-layered thermoplastic bag of FIG. 4A taken along the section line 4B-4B of FIG. 4A.

For example, FIGS. 4A-4B illustrate a multi-layered bag 200*b* similar to the multi-layered bag 200, albeit that the sidewalls 234, 236 of the inner layer or bag 228 are partially discontinuously laminated to the sidewalls 202, 204 of the outer layer or bag 201. In particular, a ribbed pattern 271 can non-continuously bond the inner layer or bag 228 to the outer layer or bag 201 and provide desirable physical characteristics. The ribbed pattern 271 and associated bonds can be formed by passing the respective sidewalls 202, 204, 234, 236 together through TD intermeshing rollers and shown and described in detail in previously incorporated by reference U.S. patent application Ser. No. 13/273,384 filed on Oct. 14, 2011.

The ribbed pattern 271 can comprise a plurality of alternating thin linear ribs 273 and thick linear ribs 272 that may extend across the sidewall 202, 204, 234, 236 substantially between the first side edge 210 and second side edges 212. As illustrated in FIG. 4B, the ribs 273, 272 may be parallel and adjacent to one another. Additionally, as illustrated in FIG. 4A, the ribbed pattern 271 may extend from the bottom edge 214 toward the opening 224. To avoid interfering with the operation of the draw tape 226, the extension of the ribbed pattern 271 may terminate below the hem seals 230, 232, as illustrated by FIG. 4B. In alternative implementations, the ribbed pattern 271 can extend from the bottom edge 214 to the top edges of each sidewall.

FIG. 4B further illustrates that the inner layer or bag 228 is bonded to the outer layer or bag 228. In particular, a first plurality of non-continuous bonded regions or bonds 274 can secure the first and second layers 202, 234, 204, 236 of the each sidewall together. Thus, the bonds 274 can comprise a pattern of linear bonds 274 extending between the first side edge 210 and the second side edge 212 of each sidewall.

As shown by FIG. 4B, in one or more implementations, the bonds 274 can bond thick linear ribs 272 of the inner layer or bag 228 to thick linear ribs 272 of the outer layer or bag 201. FIG. 4B illustrates that the bonds 274 can secure some, but not all, of the thick linear ribs 272 of one layer to the thick linear ribs 272 of an adjacent layer. In particular, FIG. 4B illustrates that bonds 274 can secure every other thick linear rib 272 of adjacent layers together. In alternative implementations, bonds 274 can secure each thick linear rib 272 of adjacent layers together. Additionally, in one or more implementations the thin linear ribs 273 may be unbounded.

FIG. 4B further illustrate that in one or more implementations of the present invention the inner bag 228 can be shorter than the outer bag 201 as more fully described in U.S. patent Ser. No. 13/412,940 filed on Mar. 6, 2012, which is hereby incorporated by reference. The shortened inner bag 228 can absorb forces and stretch to the size of the outer bag 201 before the outer bag is significantly strained. Once stretched the inner bag 228 can work in concert with the outer bag 201 to provide strength. Such implementations can provide an overall bag employing a reduced amount of raw material that nonetheless has maintained or increased strength parameters.

While FIGS. 2B-2C illustrate hem seals 230, 232 with four plies and tape seals 256, 257 with ten plies, the present invention is not so limited. For example, referring again to FIG. 4B, in contrast to the multi-layered bag 200, the inner layers or sidewalls 234, 236 can terminate at or near the top edges 220, 222.

Thus, the hems 248, 250 can include a single ply of material that is folded over and attached to the inner walls 234, 236. Thus, as shown by FIG. 4B an upper portion of the inner or second layer 234 of the first sidewall is free (not bonded) within the first hem 250. Similarly, an upper portion of the inner or second layer 236 of the second sidewall is free within the second hem 248.

Thus, in one or more implementations each of the hem seals 230, 232 can comprise three plies of thermoplastic material. One will appreciate in light of the disclosure herein that the having three plies of thermoplastic film in the hem seals 230, 232 can help provide adequate material for forming a strong seal, despite the fact that the individual layers, or even the layers as a whole, my be thinner or include less material than conventional thermoplastic bags. Additionally, as each hem flap includes two plies of thermoplastic material, the bag 200*b* can help ensure that the draw tape 226 is not pulled out from the hem flaps.

The folded over portion of the outer sidewalls 202, 204 forming the hem flaps may be folded back into the interior volume 206 and attached to the interior surface of the first sidewall 236 of the inner bag 228 at hem seals 230, 232. The hem flaps may be attached to the surfaces of the sidewalls by adhesive, heat seals or otherwise. As shown in FIG. 2B, the draw tape 226 within the hem 250 can be adjacent to, or abut against, a portion of both the inner sidewall 234 and the outer sidewall 202. Similarly, the draw tape 226 within the hem 248 can be adjacent to, or abut against, a portion of both the inner sidewall 236 and the outer sidewall 204. One will appreciate in light of the disclosure herein that the draw tape 226 can comprise a single draw tape, or alternatively two draw tapes. The first draw tape 226 can be positioned within the first hem 250, and the second draw tape 226 can be positioned within the second hem 248.

Figure 4C:
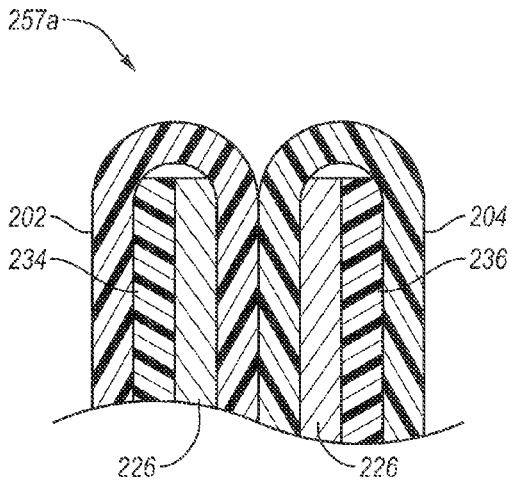
FIG. 4C illustrates a cross-sectional view of the multi-layered thermoplastic bag of FIG. 4A taken along the section line 4C-4C of FIG. 4A.

In addition, the multi-layered bag 200*b* can further include tape seals 256*a*, 257*a*. The tape seals 256*a*, 257*a* can seal the draw tape(s) 226 to one or more layers of the inner or outer bags 201, 228. FIG. 4C illustrates a cross-sectional view of the tape seal 257*a*. As shown, the tape seal 257*a* (and similarly tape seal 256*a*) can comprise seven or more plies. For example, as shown by FIG. 4C, in one or more implementations the tape seal 257*a* can comprise eight plies of material.

In particular, the tape seal 257*a* in FIG. 4C includes the outer sidewall 202 bonded to the inner sidewall 234; the inner sidewall 234 bonded to the draw tape 226; the draw tape 226 bonded to the outer sidewall 202; the outer sidewall 202 bonded to the outer sidewall 204; the outer sidewall 204 bonded to the draw tape 226; the draw tape 226 bonded to the inner sidewall 236; and the inner sidewall 236 bonded to the outer sidewall 204. As shown by FIG. 4C the only the outer sidewalls 202, 204 can each be folded over the draw tape 226 so as to be included twice in the tape seal 257*a* (i.e., on both sides of the draw tape 226).

Figure 4D:
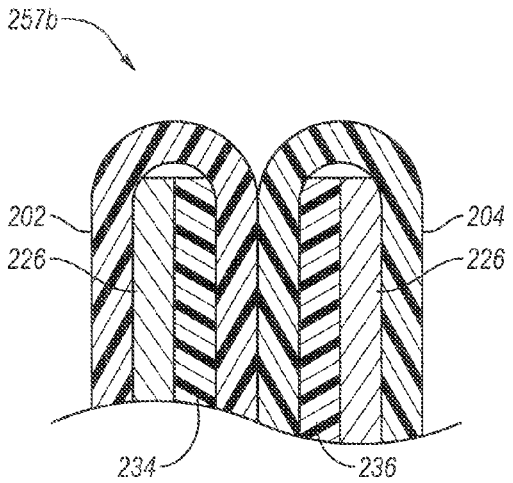
FIG. 4D illustrates a cross-sectional view of a multi-layered thermoplastic bag similar to cross-sectional view shown in FIG. 4C.
Figure 4E:
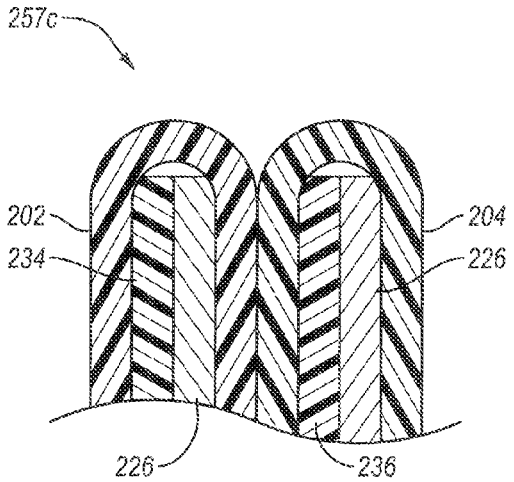
FIG. 4E illustrates a cross-sectional view of another multi-layered thermoplastic bag similar to cross-sectional view shown in FIG. 4C.
Figure 4F:
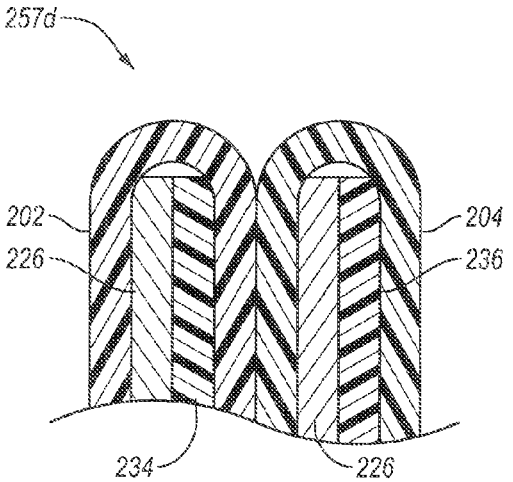
FIG. 4F illustrates a cross-sectional view of yet another multi-layered thermoplastic bag similar to cross-sectional view shown in FIG. 4C.

The configuration of the tape seal 257*a* is only one implementation of an eight-ply tape seal. One will appreciate in light of the disclosure herein that the tape seals of one or more implementations can be configured in any number of different orders or configurations. For example, FIGS. 4D-4F illustrates tape seals 257*b*-257*d* similar to the tape seal 257*a*, albeit that the order of the plies in the tape seal are different. For example, the tape seal 257*b* in FIG. 4D includes the outer sidewall 202 bonded to the draw tape 226; the draw tape 226 bonded to the inner sidewall 234; the inner sidewall 234 bonded to the outer sidewall 202; the outer sidewall 202 bonded to the outer sidewall 204; the outer sidewall 204 bonded to the inner sidewall 236; the inner sidewall 236 bonded to the draw tape 226; and the draw tape 226 bonded to the outer sidewall 204.

On the other hand, the tape seal 257*c* in FIG. 4E includes the outer sidewall 202 bonded to the inner sidewall 234; the inner sidewall 234 bonded to the draw tape 226; the draw tape 226 bonded to the outer sidewall 202; the outer sidewall 202 bonded to the outer sidewall 204; the outer sidewall 204 bonded to the inner sidewall 236; the inner sidewall 236 bonded to the draw tape 226; and the draw tape 226 bonded to the outer sidewall 204. Still further, the tape seal 257*d* in FIG. 4E includes the outer sidewall 202 bonded to the inner sidewall 234; the inner sidewall 234 bonded to the draw tape 226; the draw tape 226 bonded to the outer sidewall 202; the outer sidewall 202 bonded to the outer sidewall 204; the outer sidewall 204 bonded to the draw tape 226; the draw tape 226 bonded to the inner sidewall 236; and the inner sidewall 236 bonded to the outer sidewall 204. Thus, one will appreciate that the tape seals of the present invention can include a number of different plies in a number of different orders or configurations.

Figure 5:
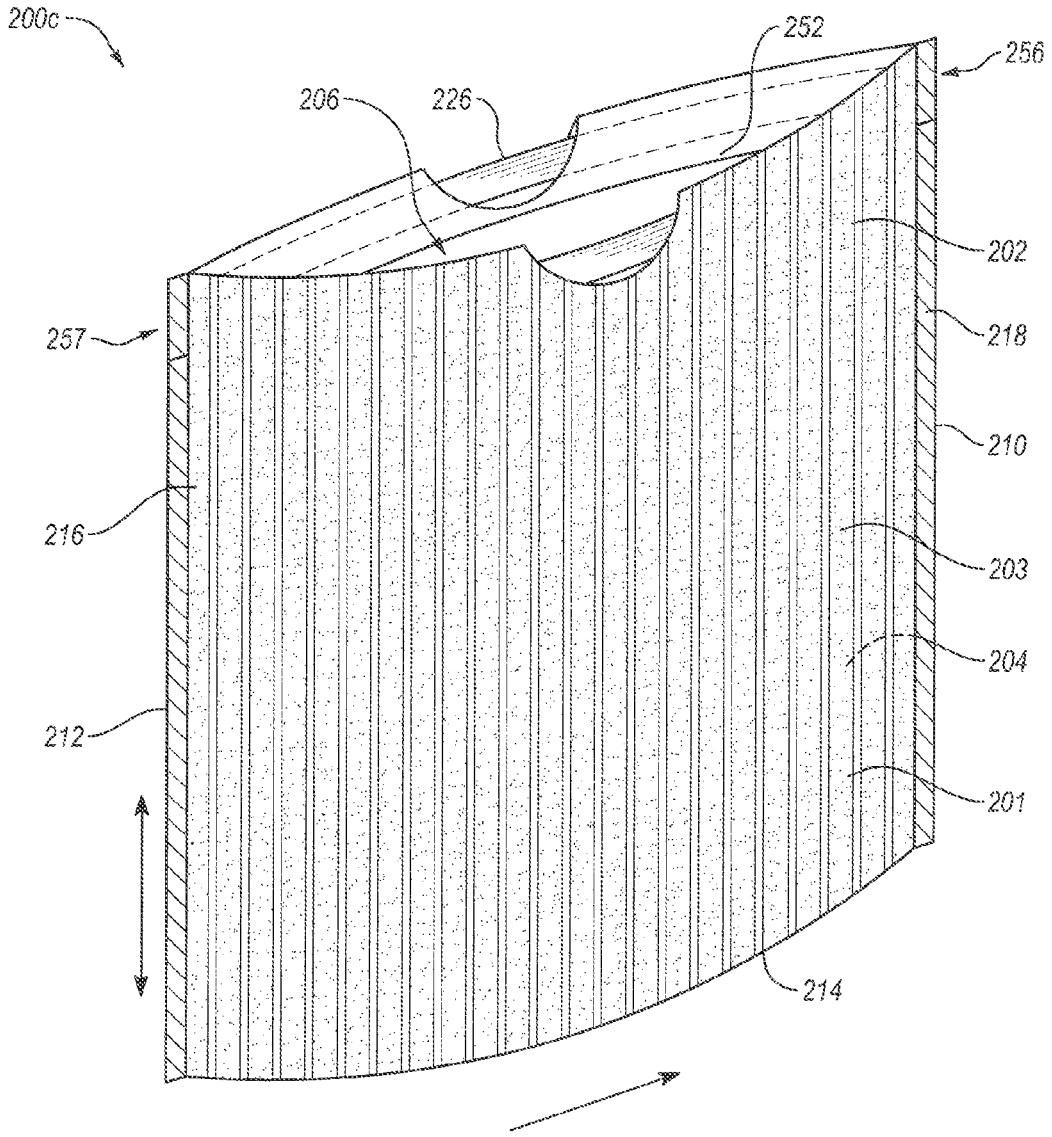
FIG. 5 illustrates a perspective view of another multi-layered thermoplastic bag with reinforced seals in accordance with one or more implementations of the present invention.
Figure 6:
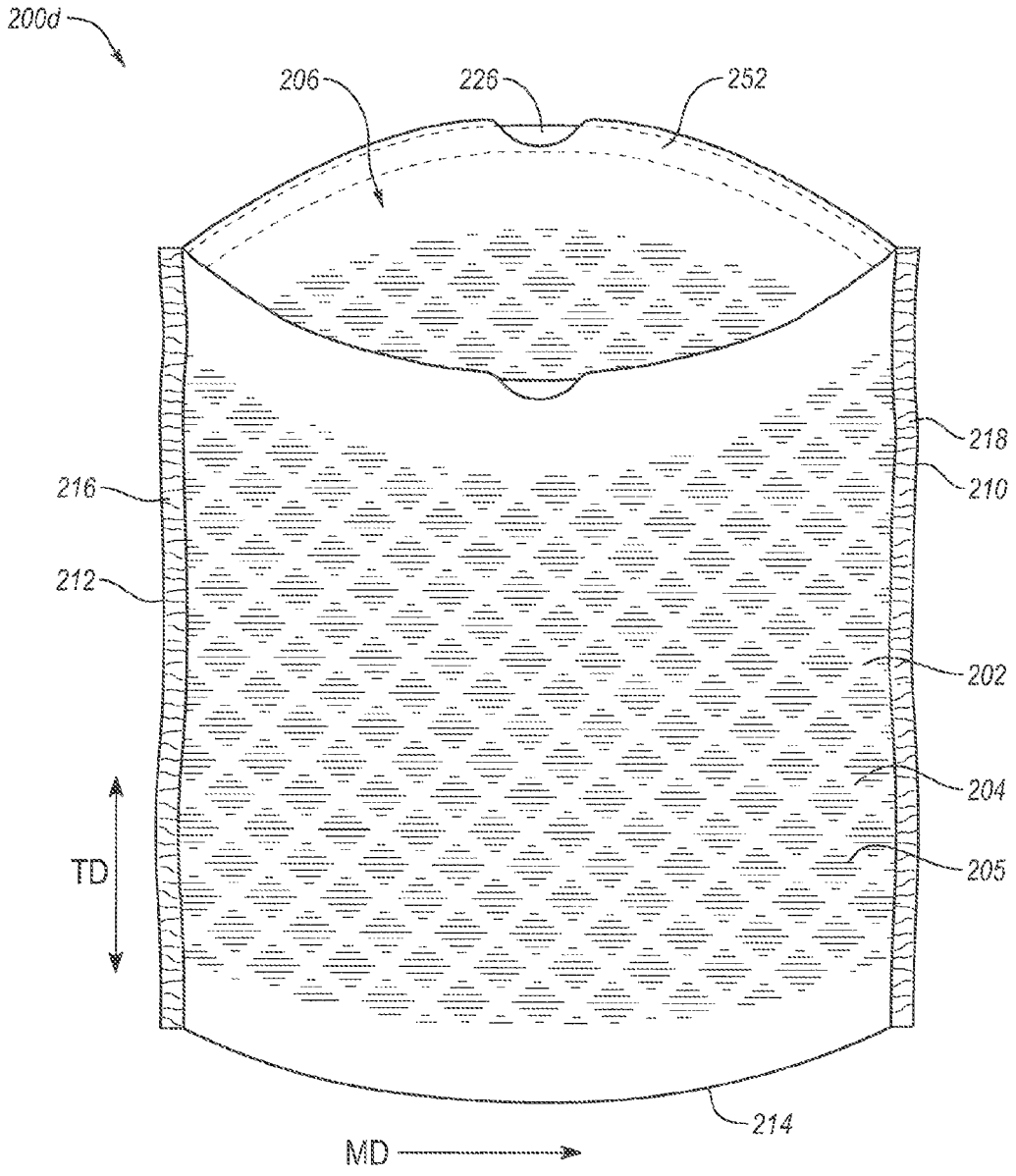
FIG. 6 illustrates a perspective view of yet another multi-layered thermoplastic bag with reinforced seals in accordance with one or more implementations of the present invention.

As mentioned previously, FIGS. 4A-4B illustrate sidewalls 202, 204, 234, 236 that have been incrementally stretched and/or bonded together using TD ring rolling. One will appreciate that the present invention is not so limited. For example, referring to FIG. 5, the thermoplastic bag 200*c* can include a first sidewall 202 and opposing second sidewall 204 overlaid and joined to the first sidewall 202 to define interior volume 206 for holding trash. Both the first sidewall 202 and the second sidewall 204 can be formed from a piece of incrementally-stretched film 203 formed by MD ring rolling and folded upon itself at folded bottom edge 214. The sidewalls 202, 204 may be joined along their side edges 210, 212 to form side seals 216, 218 and tape seals 256, 257. Referring to FIG. 6, the thermoplastic bag 200*d* has sidewalls 202, 204 with a section of strainable network patterns 205 in the middle section of the bag 200*d*.

A description of MD ring rolling and incrementally stretched strainable network pattern formation can be found in U.S. Pat. App. 2011/0117307, U.S. patent application Ser. No. 13/190,677 filed Jul. 26, 2011, and U.S. patent application Ser. No. 13/273,384 filed Oct. 14, 2011, all of which are incorporated by reference. U.S. Pat. No. 5,518,801; U.S. Pat. No. 6,139,185; U.S. Pat. No. 6,150,647; U.S. Pat. No. 6,394,651; U.S. Pat. No. 6,394,652; U.S. Pat. No. 6,513,975; U.S. Pat. No. 6,695,476; U.S. Patent Application Publication No. 2004/0134923; and U.S. Patent Application Publication No. 2006/0093766 each disclose SELFing processes for forming strainable networks or patterns of strainable networks suitable for use with implementations of the present invention. Each of the foregoing patents and applications are hereby incorporated by reference in their entirety.

Figure 7:
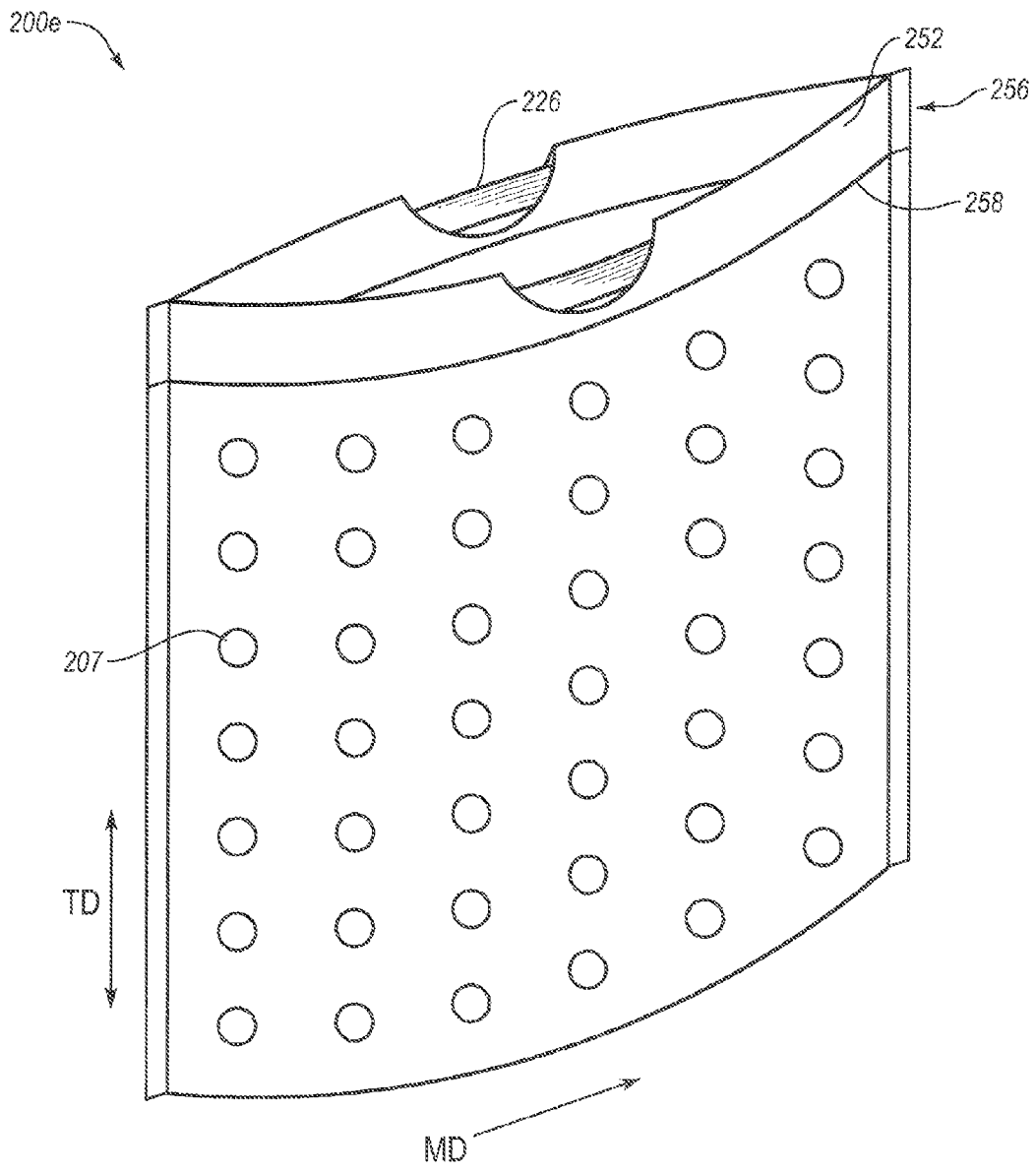
FIG. 7 illustrates a perspective view of still another multi-layered thermoplastic bag with reinforced seals in accordance with one or more implementations of the present invention.

Referring to FIG. 7, the thermoplastic bag 200*e* has been discontinuously embossed in sections 207. Where FIG. 7 represents an inner bag and an outer bag, the discontinuous embossing 207 may discontinuously laminate the inner bag to the outer bag. The bag 200*c* also has an externally folded hem 252 with a hem seal 258 and tape seals 256, 257.

Figure 8:
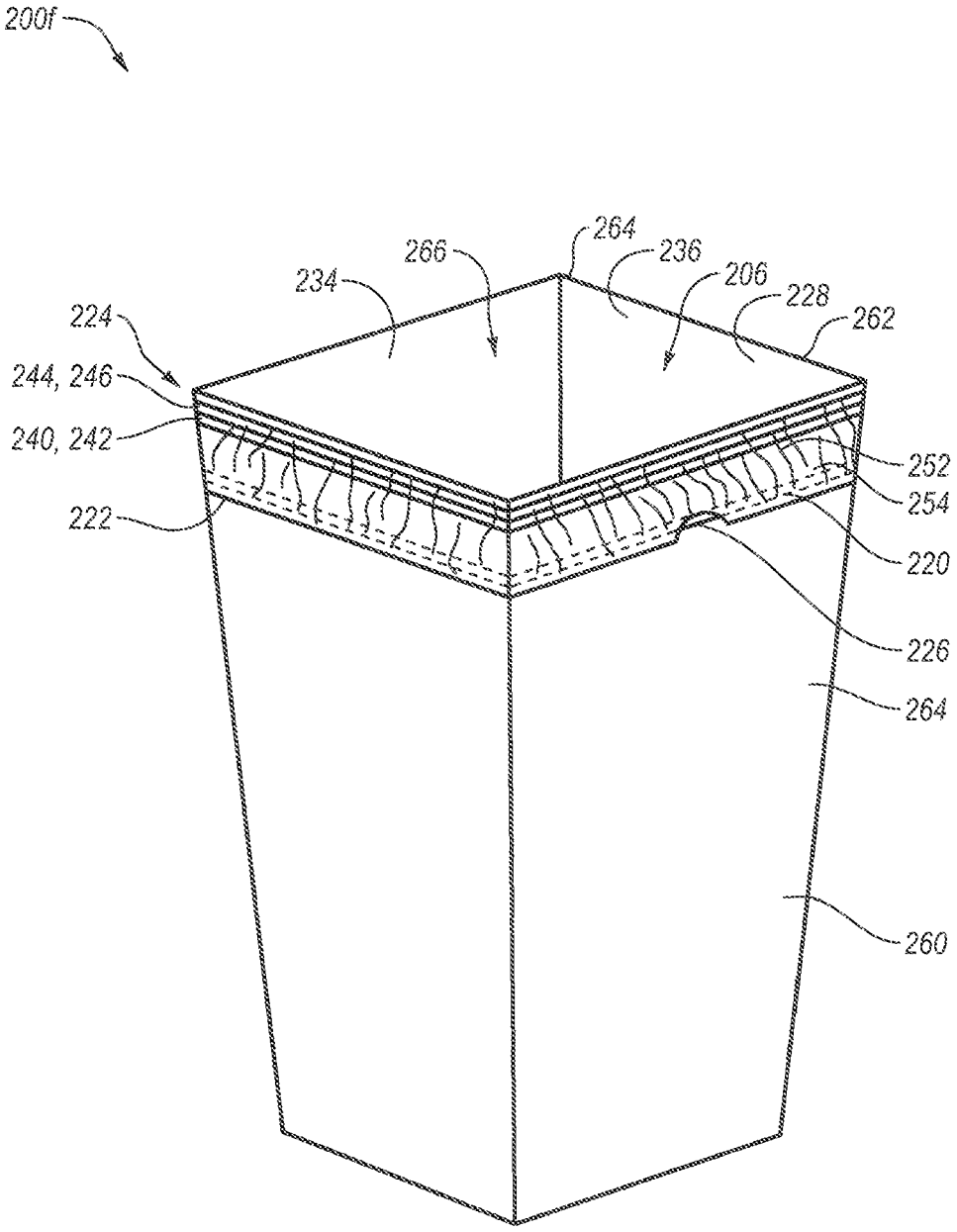
FIG. 8 is a top perspective view of multi-layered thermoplastic bag with reinforced seals inserted in, and retained to, a refuse canister.

As previously mentioned one or more bags of one or more implementations can comprise trash bags. For example, FIG. 8 illustrates the multi-layered bag 200*f*, similar to the bag 200 of FIGS. 2A-2D, fitted about a canister 260. When inserting the bag 200*f* into a canister 260, as illustrated in FIG. 8, the draw tape 226 and the top edges 220, 222 including the draw tape 226 can be folded over the upper rim 262 of the canister 260 to expose the interior surface 254 of the hem 252 and the outer bag hem flaps 242, 244 and the inner bag hem flaps 240, 246 on the outside surface 264 of the canister 260. The interior surface 254 of the hem 252 is formed from the first and second hem flaps 242, 244 of the outer bag 201 (FIGS. 2A and 2B). The interior 266 of the canister 260 can be covered by the first and second sidewalls 234, 236 of the inner bag 228. Thus, the first and second hem flaps 242, 244 of the outer bag 201 can be visible at the top of the outside surface 264 of the canister 260 and the inner bag 228 is visible on the interior 266 of the canister 260. The bag 200*f* can be positioned vertically with the canister 260 and its interior volume 206 readily exposed to receive trash. In the illustrated embodiment, the canister 260 is formed as an upright rectangular structure with a square cross section, but the bag is intended for use as a liner with trash canisters of any shape.

Thus, one will appreciate in light of the disclosure herein that a manufacturer can tailor specific sections or zones of a multi-layered bag with desirable properties by MD, TD, DD ring rolling, SELF'ing, or combinations thereof. One will appreciate in light of the disclosure herein that one or more implementations can include bonded regions arranged in other patterns/shapes. Such additional patterns include, but are not limited to, intermeshing circles, squares, diamonds, hexagons, or other polygons and shapes. Additionally, one or more implementations can include bonded regions arranged in patterns that are combinations of the illustrated and described patterns/shapes.

In another implementation, a pattern may be formed by embossing, in a process similar to ring rolling. Embossed patterns such as squares, diamonds, circles or other shapes may be embossed into a multi-layer bag. The embossed, laminated film layers may be prepared by any suitable means by utilizing two or more layers of preformed web of film and passing them between embossing rollers. The method of embossing multiple layers of film can involve calendar embossing two or more separate, non-laminated layers with discrete "icons" to form bonded areas or icons, each icon having a bonded length and separated from adjacent icons by an equivalent un-bonded length. Such icons may be any desired design or shape, such as a heart, square, triangle, diamond, trapezoid, or circle.

As mentioned previously, numerous methods can be used to provide the desired degree of lamination in the bonded areas. Any of the described ring rolling techniques may be combined with other techniques in order to further increase the strength of the lamination bond while maintaining bond strength below the strength of the weakest layer of the multi-layer film. For example, heat, pressure, ultrasonic bonding, corona treatment, or coating (e.g., printing) with adhesives may be employed. Treatment with a corona discharge can enhance any of the above methods by increasing the tackiness of the film surface so as to provide a stronger lamination bond, but which is still weaker than the tear resistance of the individual layers.

Adjusting (e.g., increasing) the strength of the relatively light lamination bonding could be achieved by addition of a tackifier or adhesive to one or more of the skin plies of a multi-layer film, or by incorporating such a component into the material from which the film layer is formed. For example, the outer skin sub layers of a given layer could contain from about 0 to about 50% of a polyolefin plastomer tackifier such as a $C_4$-$C_{10}$ olefin to adjust bonding strength by increasing the tackiness of the surfaces of adjacent layers to be lightly laminated.

In one or more implementations, a component may be included to decrease tackiness. For example, the outer skin sub layers could contain higher levels of slip or anti-block agents, such as oleamide (amide of oleic acid) or talc, to decrease tack. Similarly, these surfaces may include very low levels of or be substantially void of slip or anti-block agents to provide a relative increase in tackiness.

Implementations of the present invention can also include methods of forming multi-layered bags with reinforced seals. FIGS. 9-12 and the accompanying description describe such methods. Of course, as a preliminary matter, one of ordinary skill in the art will recognize that the methods explained in detail herein can be modified. For example, various acts of the method described can be omitted or expanded, additional acts can be included, and the order of the various acts of the method described can be altered as desired.

Figure 9:
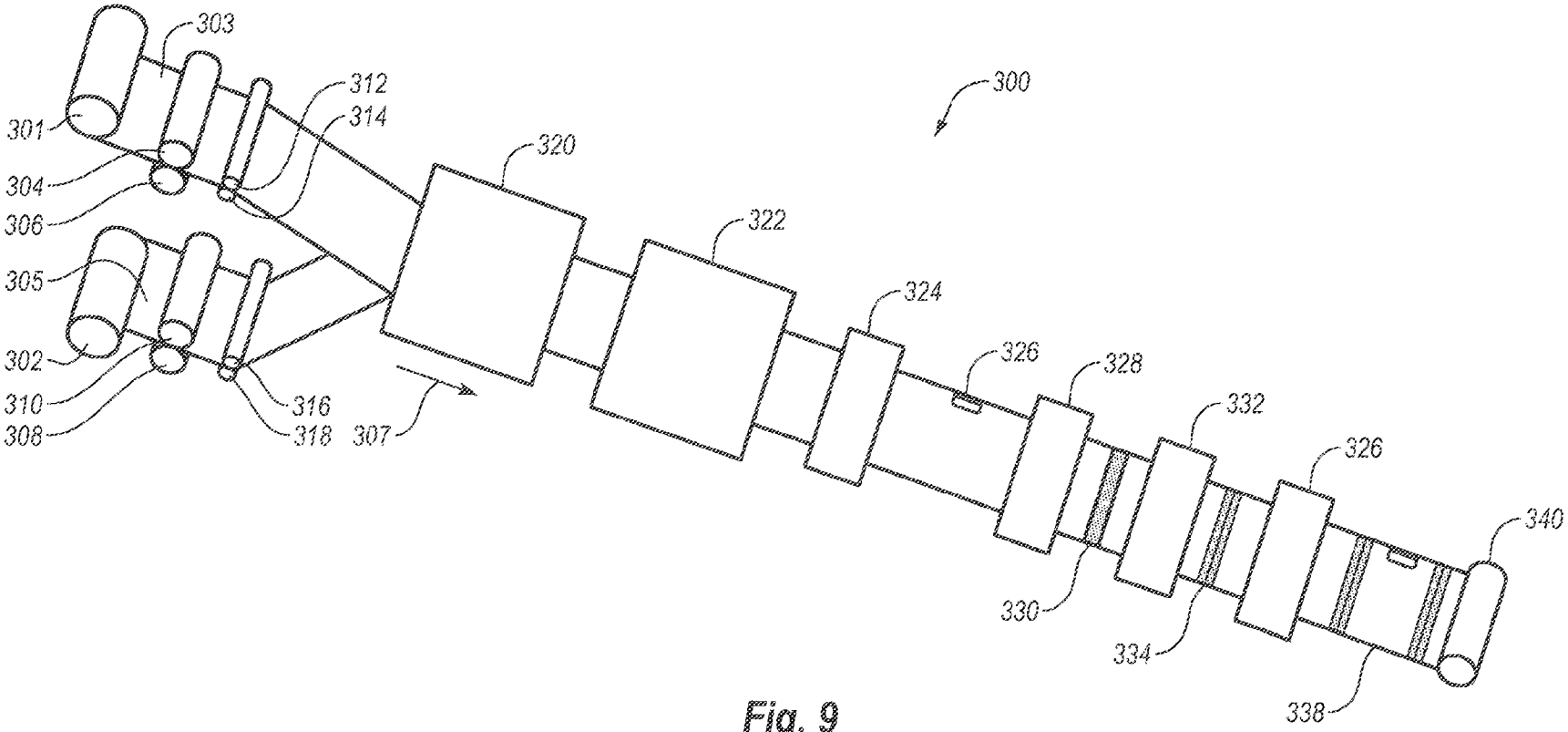
FIG. 9 illustrates a schematic diagram of a bag manufacturing process in accordance with one or more implementations of the present invention.

To produce a bag as described, continuous webs of thermoplastic material may be processed through a high-speed manufacturing environment such as that illustrated in FIG. 9. In the illustrated process 300, production may begin by unwinding a first continuous web or film 303 of thermoplastic sheet material from a roll 301 and advancing the web along a machine direction 307. In other manufacturing environments, the film 303 may be provided in other forms or even extruded directly from a thermoplastic forming process.

The process 300 can also involve unwinding a second continuous web or film of thermoplastic sheet material 305 from a roll 302 and advancing the web along a machine direction 307. The second film 305 can comprise a thermoplastic material and/or a thickness that is similar or the same as the first film 303. In alternative one or more implementations, one or more of the thermoplastic material and/or thickness of the second film 305 can differ from that of the first film 303.

The film layers 303, 305 can each comprise c-, u-, or j-folded films prior to winding on the rolls 301, 302. Thus, in such implementations, the films 303, 305 unwound from the rolls 301, 302 are already folded. In alternative implementations, the method 300 can involve folding the films 303, 305 after unwinding them from the rolls 301, 302.

Additionally, the manufacturing process 300 illustrates that each film 303, 305 can pass through a set of intermeshing rollers 304, 306, 308, 310 to incrementally stretch the films (and impart a ribbed pattern thereto) prior to bonding. One will appreciate in light of the disclosure herein that the intermeshing rollers can comprise TD ring rolls, MD ring rolls, DD ring rolls, SELFing rollers, embossing rollers, other intermeshing rollers, or combinations of the foregoing.

The films 303, 305 can also pass through pairs of pinch rollers 312, 314, 316, 318. The pinch rollers 312, 314, 316, 318 can be appropriately arranged to grasp the folded films 303, 305. The pinch rollers 312, 314, 316, 318 may facilitate and accommodate the folded films 303, 305.

The manufacturing process 300 can then include an insertion operation 320 for inserting the folded film 303 into the folded film 305. Insertion operation 320 can combine the folded films 303, 305 using any of the apparatus and methods described in U.S. patent application Ser. No. 13/225,757 filed on Sep. 6, 2011 and U.S. patent application Ser. No. 13/225,930 filed on Sep. 6, 2011, each of which are incorporated herein by reference in their entirety.

Additionally, FIG. 9 illustrates that the combined film layers 303, 305 can then pass through a lamination operation 322 to lightly bond or laminate the films 303, 305 together. Lamination operation 322 can lightly laminate the folded films 303, 305 together via adhesive bonding, pressure bonding, ultrasonic bonding, corona lamination, and the like. Alternatively, lamination operation 322 can lightly laminate the folded films 303, 305 together by passing them through machine-direction ring rolls, transverse-direction ring rolls, diagonal-direction ring rolls, SELF'ing rollers, embossing rollers, or other intermeshing rollers.

To produce the finished bag, the processing equipment may further process the folded web. For example, the processing equipment may further process the multi-layer composite folded film after it emerges from the insertion/lamination operations 320, 322. In particular, a draw tape operation 324 can insert a draw tape 326 into the composite folded film. For example, the method 300 can involve inserting a first draw tape 226 within a first hem 230 of a first multi-layered sidewall (FIG. 2B) and inserting a second draw tape 226 within a second hem 232 of a second multi-layered sidewall.

Furthermore, a sealing operation 328 can form the parallel side edges of the finished bag by forming heat seals 330 between adjacent portions of the multi-layer composite folded film. The heat seals 330 may be incrementally spaced apart along the multi-layer composite folded film. The sealing operation 328 can form the heat seals 330 using a heating device, such as a heated seal bar, a heating device, such as, a heated knife. A perforating operation 332 may form perforations 334 in the heat seals 330 with a perforating device, such as, a perforating knife so that individual bags 338 may be separated from the web. In one or more implementations, the webs may be folded one or more times before the folded webs may be directed through the perforating operation. The webs 303, 305 embodying the finished multi-layered bags 338 may be wound into a roll 340 for packaging and distribution. For example, the roll 338 may be placed in a box or a bag for sale to a customer.

In still further implementations, the multi-layer composite folded film may be cut into individual bags along the heat seals 330 by a cutting operation 336. In yet another implementation, the side sealing operation 328 may be combined with the cutting and/or perforation operations 332, 336.

Figure 10A:
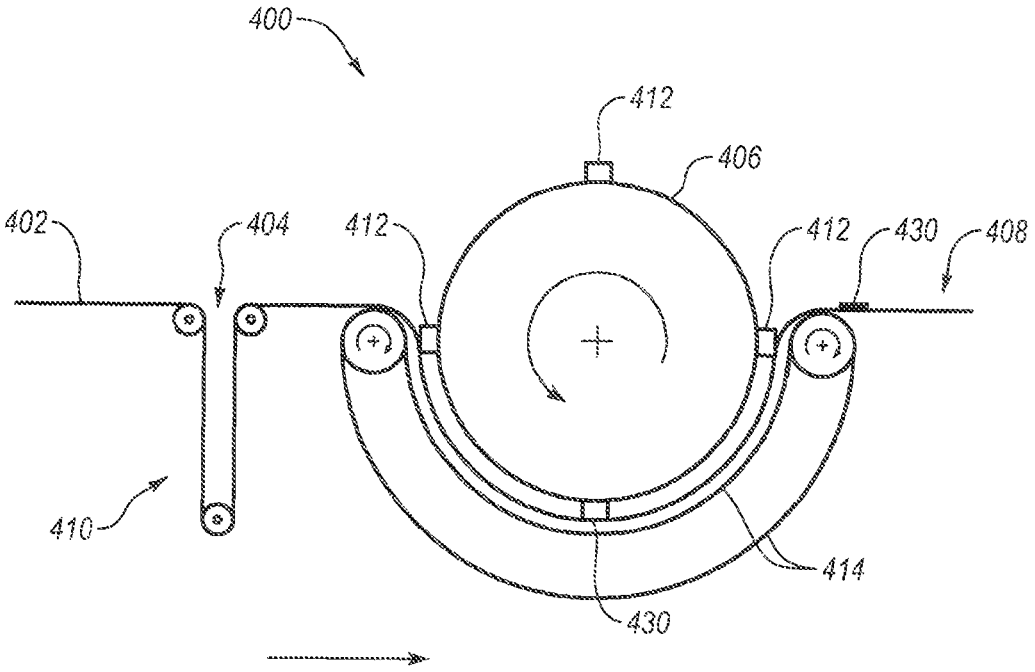
FIGS. 10A and 10B illustrate a sealing process in accordance with one or more implementations of the present invention.

The sealing operation 328 shown in FIG. 9 can be part of a continuous (FIGS. 10A and 10B) or reciprocating (FIG. 12) bag-making process. As shown in FIG. 10A, a continuous sealing process 400 typically has an input section 404, a rotary drum 406, and an output section 408. The film plies 402 continuously travel from the input section 404 to the rotary drum 406 and then to the output section 408.

The input section generally consists of a driven dancer assembly 410 to control film tension. The rotary drum 406 contains a plurality of heated seal bars 412 which can press against a sealing blanket 414 to make seals 430 on the film plies 402. The heated seal bars 412 can only heat the film plies 402 from one side.

End to end bags are formed with one seal 430 from the drum 406 and side-to-side bags are formed with a pair of seals 430. The drum 406 diameter may be adjusted and/or less than all of the seal bars 412 turned on to determine the distance between seals 430, and hence, bag size. The output section 408 generally includes assemblies that act on the film plies 402 downstream of the seals 430 being formed, such as perforators, winders, folders and the like. The continuous bag making process 400 has the advantage of operating at very high speeds (600 ft./min=300 bags/min).

Figure 10B:
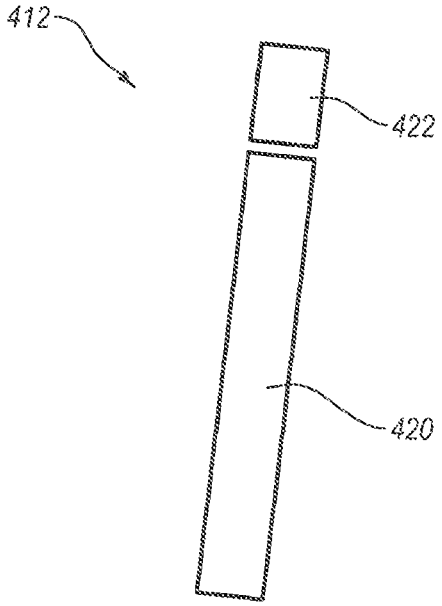

The continuous bag making process 400 can additionally be used to make both the side seals 216, 218 and the tape seals 256, 257, as shown in FIGS. 2A and 2B. Because the tape seals 256, 257 can involve more plies of material or different materials compared with the side seals 216, 218, the seal bars 412 can be divided into two individual seal bars. In particular, the seal bars can include a long seal side seal bar 420 and a shorter tape seal bar 422, as shown in FIG. 10B. Because the bag 200 may have more or different plies of material in the side seals 216, 218 and the tape seals 256, 257, the side seal bar 420 may have different heating properties from the tape seal bar 422. For example, the tape seal bar 420 may be heated to a higher temperature to penetrate the additional plies in the tape seals 256, 257. The continuous sealing process 400 can also be used to form hem seals 230, 232 (FIG. 2A). Alternatively, the hem seals 230, 232 may be formed by hot air heating rather than by inductive heating.

Figure 11:
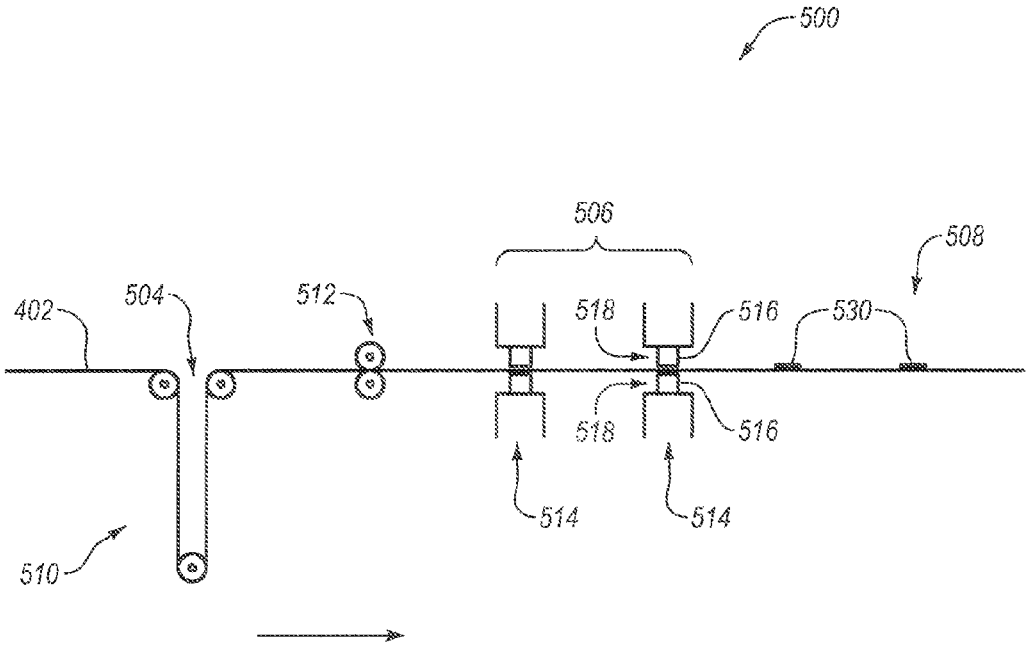
FIG. 11 illustrates another sealing process in accordance with one or more implementations of the present invention.

As shown in FIG. 11, a reciprocating sealing process 500 typically has an input section 504, a linear sealing section 506, and an output section 508. The input section 504 generally includes of a dancer assembly 510, and a driven nip 512. The film plies 402 are unwound continuously from a roll or during a continuous process and pass through the dancer assembly 510 to the driven nip 512. The driven nip 512 rotates intermittently, with one cycle of rotation reflecting the width of one bag. The nip 512 can stop for sealing and the time the nip 512 is motionless is adjustable as required for downstream operations (such as sealing).

The dancer assembly 510, prior to the intermittently operating nip 512 and after the continuously operating unwind or process, can gather the film plies 402 during the time the nip 512 is not rotating. This can provide enough film plies 402 to satisfy the requirements of the nip 512 when it begins rotating again. Hence, in the input section 504, the film plies 402 can move in a continuous manner, travel through a dancer assembly 510 that gathers the film plies 402, and through a nip 512 that operates in an intermittent manner, converting the film plies 402 motion from a continuous motion to an intermittent motion, one bag width at a time.

The linear sealing section 506 of a reciprocating bag making process 500 can include of one or more sealing stations 514 with heated seal bars 516 spaced one bag width apart. The heated seal bars 516 can contact the film plies 402 each time the film plies 402 motion stops as the film plies 402 travel in a straight path through the machine. During the film plies 402 stoppage time, each seal bar 516 on a sealing station 514 can move from a stationary position 518 above or below the web to a position which places the seal bar 516 in contact with the film plies 402 from both sides. The seal bar 516 can then contact the film plies 402 for a period of time as required to make a seal 530. The seal bar 516 can then retract to its original stationary position 518, after which the film plies 402 advance intermittently a multiple of one or more bag widths and the process is repeated. One or more sealing stations 514 may be required to provide the residence time as required for the seal 530. The reciprocating process 500 has the advantage of long residence times, heating the film plies from both sides and high quality seals 530, but can be limited in rate (typically 120 bags/min).

Figure 12:
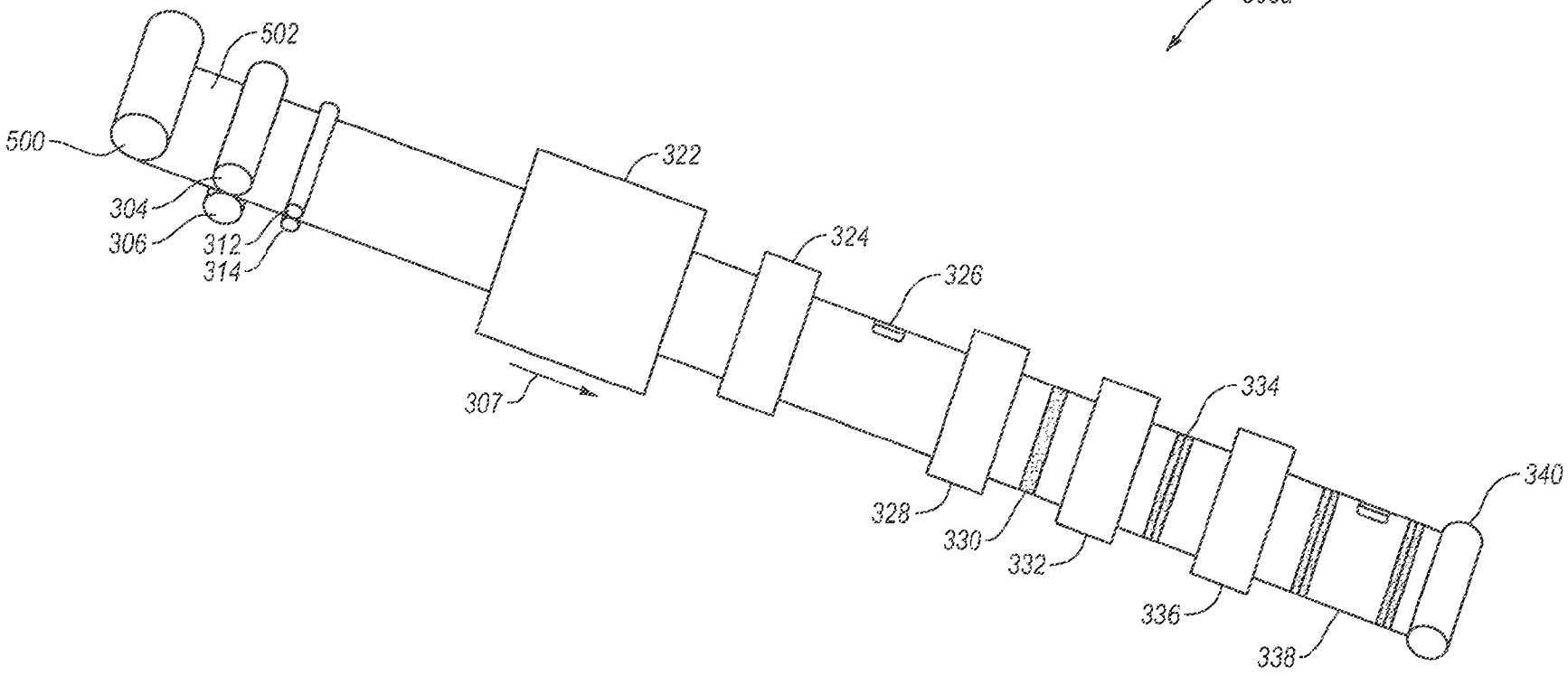
FIG. 12 illustrates a schematic diagram of another bag manufacturing process in accordance with one or more implementations of the present invention.

FIG. 12 illustrates another manufacturing process 300*a* for producing a multi-layered bag with reinforced seals. The process 300*a* can be similar to process 200 of FIG. 9, except that the film layers 301, 305 are folded in half to form c-, u-, or j-folded films and the film 301 is inserted within film 305 prior to winding on the roll 500. Thus, in such implementations, the films 301, 305 unwound from the roll 500 are already folded and inserted together.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. Moreover, any combination of the above-described elements in all possible variations thereof is encompassed by the invention unless otherwise indicated herein or otherwise clearly contradicted by context. All changes that come within the meaning and range of equivalency of the claims are to be embraced within their scope.

We claim:

1. A multi-layered thermoplastic bag, comprising:

a first thermoplastic bag comprising first and second opposing sidewalls joined together along a first side edge, an opposite second side edge, and a bottom edge, the first and second sidewalls being un-joined along at least a portion of their respective top edges to define an opening; and a second thermoplastic bag positioned within the first thermoplastic bag, the second thermoplastic bag comprising third and fourth opposing sidewalls joined together along a first side edge, an opposite second side edge, and a bottom edge, the third and fourth sidewalls being un-joined along at least a portion of their respective top edges to define an opening;

at least one draw tape extending along the top edges of the first and second thermoplastic bags; and at least one tape seal bonding the draw tape to the first and second thermoplastic bags;

wherein the at least one tape seal comprises at least seven discrete film plies bonded together, wherein each of the at least seven discrete film plies are formed separately from the other film plies of the at least seven discrete film plies and wherein each of the seven discrete film plies comprises a plurality of co-extruded sublayers.

2. The multi-layered thermoplastic bag as recited in claim 1, wherein the at least seven film plies of the at least one tape seal comprise a first portion of the first sidewall of the first thermoplastic bag, a first portion of the first sidewall of the second thermoplastic bag, a first portion of the at least one draw tape, a second portion of the first sidewall of the first thermoplastic bag, a first portion of the second sidewall of the first thermoplastic bag, a first portion of the second sidewall of the second thermoplastic bag, and a second portion of the second sidewall of the first thermoplastic bag.

3. The multi-layered thermoplastic bag as recited in claim 2, wherein the at least seven film plies of the at least one tape seal further comprise a second portion of the at least one draw tape.

4. The multi-layered thermoplastic bag as recited in claim 3, wherein the first portion of the at least one draw tape is bonded directly between one of the first portion and the second portion of the first sidewall of the first thermoplastic bag and a first portion of the first sidewall of the second thermoplastic bag.

5. The multi-layered thermoplastic bag as recited in claim 3, wherein the at least seven film plies of the at least one tape seal further comprise a second portion of the first sidewall of the second thermoplastic bag and a second portion of the second sidewall of the second thermoplastic bag.

6. The multi-layered thermoplastic bag as recited in claim 5, wherein the first portion of the at least one draw tape is bonded directly between the first portion and the second portion of the second sidewall of the second thermoplastic bag.

7. The multi-layered thermoplastic bag as recited in claim 5, wherein:

the second portions of the first and second sidewalls of the second thermoplastic bag are folded over into an interior of the multi-layered thermoplastic bag; and the second portions of the first and second sidewalls of the first thermoplastic bag are folded over into the interior of the multi-layered thermoplastic bag.

8. The multi-layered thermoplastic bag as recited in claim 1, further comprising at least one hem seal, wherein the at least one hem seal:

bonds the first sidewall of the first thermoplastic bag to the first sidewall of the second thermoplastic bag; and comprises at least three film plies.

9. The multi-layered thermoplastic bag as recited in claim 8, wherein the at least three film plies of the at least one hem seal comprise a first portion of the first sidewall of the first thermoplastic bag, a first portion of the first sidewall of the second thermoplastic bag; and a second portion of the first sidewall of the first thermoplastic bag.

10. A multi-layered bag, comprising:

a first sidewall comprising a first layer of a thermoplastic material and an adjacent second layer of thermoplastic material;

a second sidewall comprising a first layer of a thermoplastic material and an adjacent second layer of thermoplastic material;

first and second draw tapes configured to selectively draw the first and second sidewalls toward each other;

a first tape seal bonding at least six discrete plies of the first and second sidewalls to first ends of the first and second draw tapes, wherein each of the at least six discrete film plies of the first tape seal are formed separately from the other film plies of the at least six discrete film plies of the first tape seal;

a second tape seal bonding at least six discrete plies of the first and second sidewalls to second ends of the first and second draw tapes, wherein each of the at least six discrete film plies of the second tape seal are formed separately from the other film plies of the at least six discrete film plies of the second tape seal and wherein each of the at least six discrete plies comprises a plurality of co-extruded sublayers.

11. The multi-layered bag as recited in claim 10, further comprising a plurality of non-continuous bonds securing first and second layers of the first sidewall together.

12. The multi-layered bag as recited in claim 11, wherein the plurality of non-continuous bonds comprise one of ultrasonic bonds, adhesive bonds, bonds formed from MD ring rolling, bonds formed from TD ring rolling, bonds formed from embossing, or bonds formed from SELFing.

13. The multi-layered bag as recited in claim 10, wherein:

the first layers of the first and second sidewalls each have a first length; and the second layers of the first and second sidewalls each have a second length that is less than the first length.

14. The multi-layered bag as recited in claim 10, wherein:

the first layers of the first and second sidewalls each have a first color; and the second layers of the first and second sidewalls each have a second color.

15. The multi-layered bag as recited in claim 10, further comprising:

a first hem formed by a fold of one or more of first layer and the adjacent second layer of the first sidewall extending into an interior of the multi-layered bag;

a second hem formed by a fold of one or more of the first layer and the adjacent second layer of the second sidewall extending into the interior of the multi-layered bag.

16. The multi-layered bag as recited in claim 15, further comprising:

a first hem seal that bonds the first hem to the first sidewall, the first hem comprising at least three plies; and a second hem seal that bonds the second hem to the second sidewall, the second hem comprising at least three plies.

17. The multi-layered bag as recited in claim 16, wherein:

an upper portion of the second layer of the first sidewall is free within the first hem; and an upper portion of the second layer of the second sidewall is free within the second hem.

18. The multi-layered bag as recited in claim 10, wherein the first and second layers of the first and second sidewalls each comprise co-extruded tri-layered film.

19. The multi-layered bag as recited in claim 18, wherein:

exterior layers of the co-extruded tri-layered film comprise linear low-density polyethylene; and a middle layer of the co-extruded tri-layered film differs in composition from the exterior layers of the co-extruded tri-layered film.

20. The multi-layered thermoplastic bag as recited in claim 1, wherein the first and second sidewalls of one or more of the first thermoplastic bag or the second thermoplastic bag comprise a co-extruded tri-layered film.

* * * * *